US006871814B2

(12) United States Patent
Daul et al.

(10) Patent No.: US 6,871,814 B2
(45) Date of Patent: Mar. 29, 2005

(54) APPARATUS FOR APPLYING GLUE TO CORES

(75) Inventors: Thomas J. Daul, Oneida, WI (US); Steve J. Jansen, De Pere, WI (US); Robert W. Zeratsky, Jr., Green Bay, WI (US)

(73) Assignee: Paper Converting Machine Company, Green Bay, WI (US)

( * ) Notice: Subject to any disclaimer, the term of this patent is extended or adjusted under 35 U.S.C. 154(b) by 0 days.

(21) Appl. No.: 10/271,040

(22) Filed: Oct. 15, 2002

(65) Prior Publication Data

US 2003/0037725 A1 Feb. 27, 2003

Related U.S. Application Data

(60) Division of application No. 09/559,865, filed on Apr. 26, 2000, now Pat. No. 6,447,383, which is a continuation-in-part of application No. 09/204,906, filed on Dec. 3, 1998, now Pat. No. 6,056,229.

(51) Int. Cl.[7] ..... B65H 18/20

(52) U.S. Cl. ..... 242/521; 242/532.3; 242/533; 242/541.2

(58) Field of Search ..... 242/521, 533, 242/533.1, 533.2, 541.2, 542, 542.1, 542.2, 542.4, 572.3

(56) References Cited

U.S. PATENT DOCUMENTS

| | | | | | |
|---|---|---|---|---|---|
| 3,704,835 | A | * | 12/1972 | Harley | 242/523.1 |
| 3,795,221 | A | * | 3/1974 | Michael | 118/261 |
| RE28,353 | E | | 3/1975 | Nytsrand | |
| 4,327,877 | A | * | 5/1982 | Perini | 242/521 |
| 4,487,377 | A | * | 12/1984 | Perini | 242/521 |
| 4,723,724 | A | | 2/1988 | Bradley | |
| 4,828,195 | A | | 5/1989 | Hertel | |
| 4,856,725 | A | | 8/1989 | Bradley | |
| 4,909,452 | A | | 3/1990 | Hertel | |
| 4,962,897 | A | | 10/1990 | Bradley | |
| 5,040,738 | A | * | 8/1991 | Biagiotti | 242/532.3 |
| 5,104,055 | A | | 4/1992 | Buxton | |
| 5,137,225 | A | | 8/1992 | Biagiotti | |
| 5,368,252 | A | | 11/1994 | Biagiotti | |
| 5,370,335 | A | | 12/1994 | Vigneau | |
| 5,421,536 | A | | 6/1995 | Hertel | |
| 5,505,405 | A | | 4/1996 | Vigneau | |
| 5,542,622 | A | * | 8/1996 | Biagiotti | 242/521 |
| 5,603,467 | A | * | 2/1997 | Perini et al. | 242/521 |
| 5,643,398 | A | * | 7/1997 | Lumberg | 156/446 |
| 5,653,401 | A | * | 8/1997 | Biagiotti | 242/532.3 |
| 5,769,352 | A | * | 6/1998 | Biagiotti | 242/521 |
| 5,800,652 | A | * | 9/1998 | Vigneau et al. | 156/184 |
| 5,820,064 | A | * | 10/1998 | Butterworth | 242/533.2 |
| 5,979,818 | A | | 11/1999 | Perini | |
| 6,056,229 | A | * | 5/2000 | Blume et al. | 242/521 |
| 6,098,557 | A | * | 8/2000 | Couillard et al. | 112/475.06 |
| 6,422,501 | B1 | * | 7/2002 | Hertel et al. | 242/532.3 |

FOREIGN PATENT DOCUMENTS

| | | |
|---|---|---|
| EP | 694 020 B1 | 9/1997 |
| WO | WO 95/34498 | 12/1995 |

OTHER PUBLICATIONS

Paper Converting Machine Company Publication 01–38–29 (1997).

(Continued)

*Primary Examiner*—Emmanuel Marcelo

(57) ABSTRACT

A glue applicator for a web winding apparatus applies a longitudinal stripe of glue to an elongated core. The stripe of glue may be applied by an elongated wire or bar, by a rotating roller, or by a sprayer. The glued core is moved by a core inserter into position for insertion into the winding apparatus so that the stripe of glue is upstream of the web and in position to contact the web at the start of a new winding cycle. A web pinch pad on the core inserter contacts the web and severs the web at the start of the winding cycle.

13 Claims, 26 Drawing Sheets

OTHER PUBLICATIONS

Paper Converting Machine Company Publication 09–45–10 (1997).
Paper Converting Machine Company Publication 01–27–06 (1997).
Paper Converting Machine Company Publication 09–27–07 (1997).
Paper Converting Machine Company Publication 0138049eqzd (1999).
Paper Converting Machine Company Publication 0127015e.qxd (1999).
Paper Converting Machine Company Publication 01–27–07 (1997).
Paper Converting Machine Company Publication 0138049eqxd (1999).
Paper Converting Machine Company Publication 01–27–10 (1997).

* cited by examiner

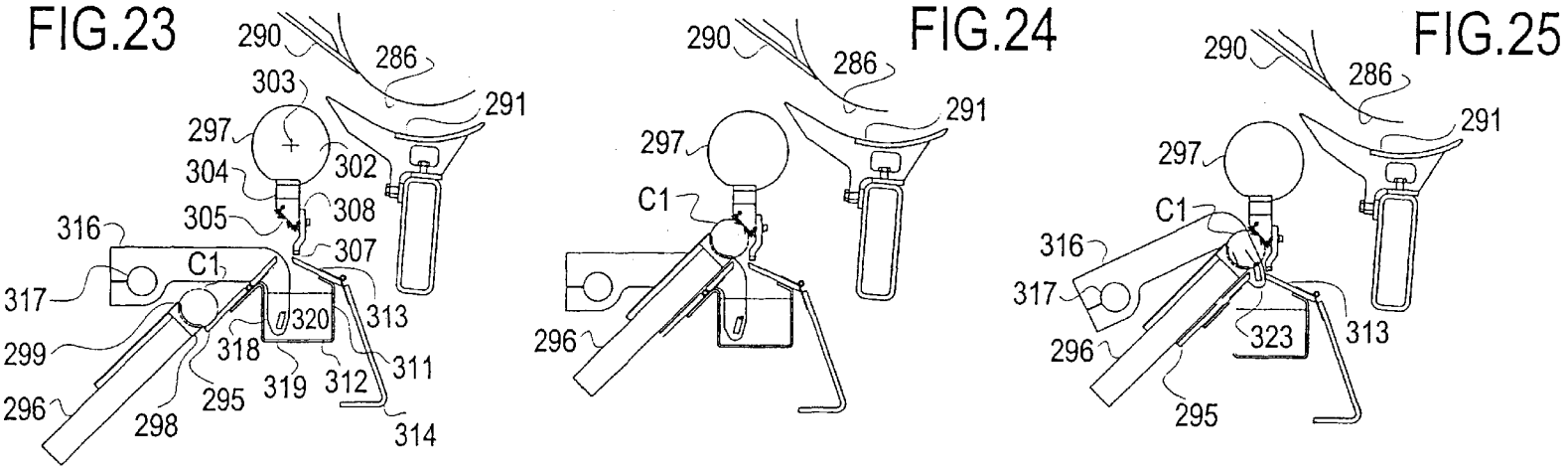
FIG.23
FIG.24
FIG.25
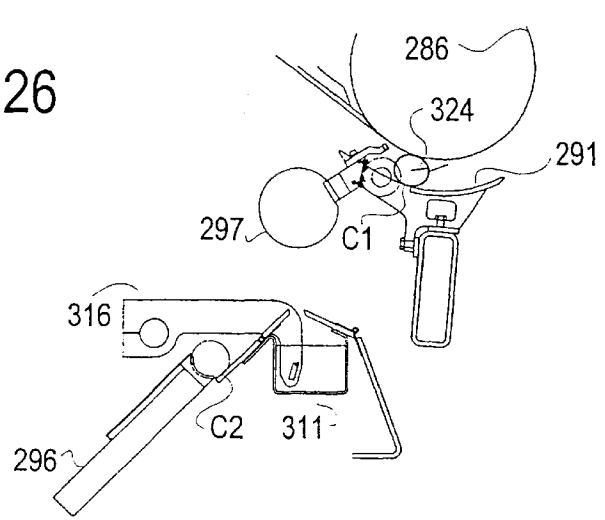
FIG.27
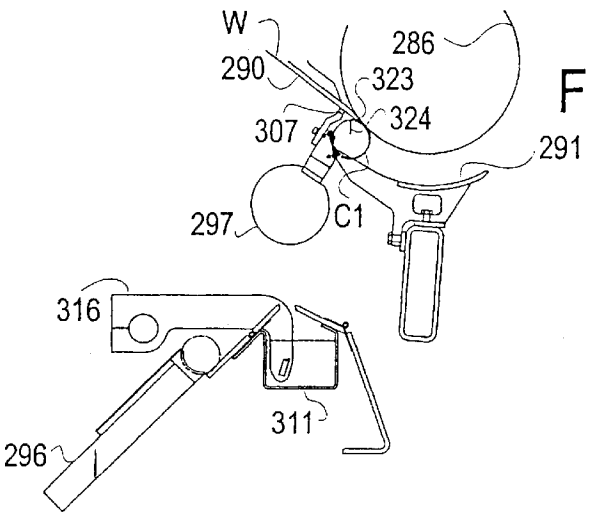
FIG.26

345

APPARATUS FOR APPLYING GLUE TO CORES

RELATED APPLICATION

This application is a division of U.S. patent application Ser. No. 09/559,865, filed Apr. 26, 2000, now U.S. Pat. No. 6,497,383, which was a continuation-in-part of U.S. patent application Ser. No. 09/204,906, filed Dec. 3, 1998, now U.S. Pat. No. 6,056,229.

BACKGROUND

Rewinders are used to convert large parent rolls of paper into retail sized rolls and bathroom tissue and paper towels. Two types of rewinders are commonly used—center rewinders and surface rewinders. Center rewinders are described, for example, in U.S. Reissue Pat. No. 28,353 and wind the web on a core which is rotated by a mandrel. Surface rewinders are described, for example, in U.S. Pat. Nos. 4,723,724 and 5,104,055 and wind the web on a core which is rotated by a three roll cradle.

The critical operation in both center rewinders and surface rewinders is the sequence of steps referred to as cutoff and transfer. The web must be severed to end the winding of one roll, the leading edge of the severed web must be transferred to a new core, and the new core must be rotated to begin winding a new roll. These steps must be accomplished repeatedly and reliably while the web is moving at high speed. It is also desirable that each roll have exact sheet count and that the web is wound uniformly and substantially without wrinkles.

In U.S. Pat. No. 4,723,724 a stationary plate or dead plate (217 in FIGS. 11–15; 317 in FIG. 18; 417 in FIG. 18A) upstream of the second winding roll is used to initiate core rotation and to transfer the web to a glue-equipped core. The core pinches the web against the stationary plate to tension and sever the web, and the web is wound on the core as the core rolls along the stationary plate. In FIGS. 11–15 a rotating pinch arm 221 presses the web against an upper belt 209 to isolate a line of perforations P on which the web is severed.

U.S. Pat. No. 5,137,225 also describes a surface rewinder which uses a stationary surface to effect a temporary braking of the web between the stationary surface and the core, thus causing a tearing of the web between the just-finished roll and the incoming core. This process, which uses the core to pinch and slow down the web, stretches the web from the pinch point of the core to the finished wound roll to snap a perforation between the two points. This long distance between the core and the finished roll must be elongated by at least the percentage of stretch in the material, commonly 6 to 25%. This elongation is created by the core being pinched to the stationary surface with the core insertion speed being less than the web speed. In effect, there is at least the same amount of slack web generated upstream of the inserted core as is required to elongate and break the web downstream of the core, plus the distance the core must still travel before it reaches the first winding roll and is accelerated to web speed.

The problems with this method are the significant amount of slack web generated upstream, and the difficulty in running short perforations which result in more than one perforation between the inserted core and the finished wound roll. The excess generated slack causes uncontrollable wrinkling and web tension problems which limit the speed of the machine. The long distance from the core to the finished wound roll also limits the length of perforation which can be run, and the maximum stretch which can be run. This method also requires a stiff core to pinch the web to the stationary surface to minimize slippage of the web as it is stretched, thus increasing the cost of the cores.

European Patent 0 694 020B1 and U.S. Pat. No. 5,979,818 use a pad/presser member to cooperate with surface portions of the first winding roll which have a low coefficient of friction. This low coefficient of friction on the first winding roll is highly undesirable as it permits winding products to become unstable during winding due to slippage between the product and the winding drums. This is explained in U.S. Pat. Nos. 5,370,335 and 5,505,405.

SUMMARY OF THE INVENTION

The invention rapidly applies a longitudinally extending stripe of glue along the length of a core while the core is under the control of a core handling apparatus of a winding machine. The position of the stripe of glue is therefore accurately controlled. The core handling apparatus moves the core into position for insertion into the web winding apparatus so that the glue stripe is located to contact the web at the proper time in a new winding cycle.

DESCRIPTION OF THE DRAWING

The invention will be explained in conjunction with illustrative embodiments shown in the accompanying drawing, in which—

FIG. 23 is a fragmentary view of a core on the core pusher of the glue applying apparatus;

FIG. 24 illustrates the core being pushed onto the core inserter;

FIG. 25 illustrates a line of glue being applied to the core;

FIG. 26 illustrates the core inserter positioning the core for the start of a new winding cycle;

FIG. 27 illustrates the web being transferred to the glued core to begin a new winding cycle;

DESCRIPTION OF SPECIFIC EMBODIMENTS

Figure 1:
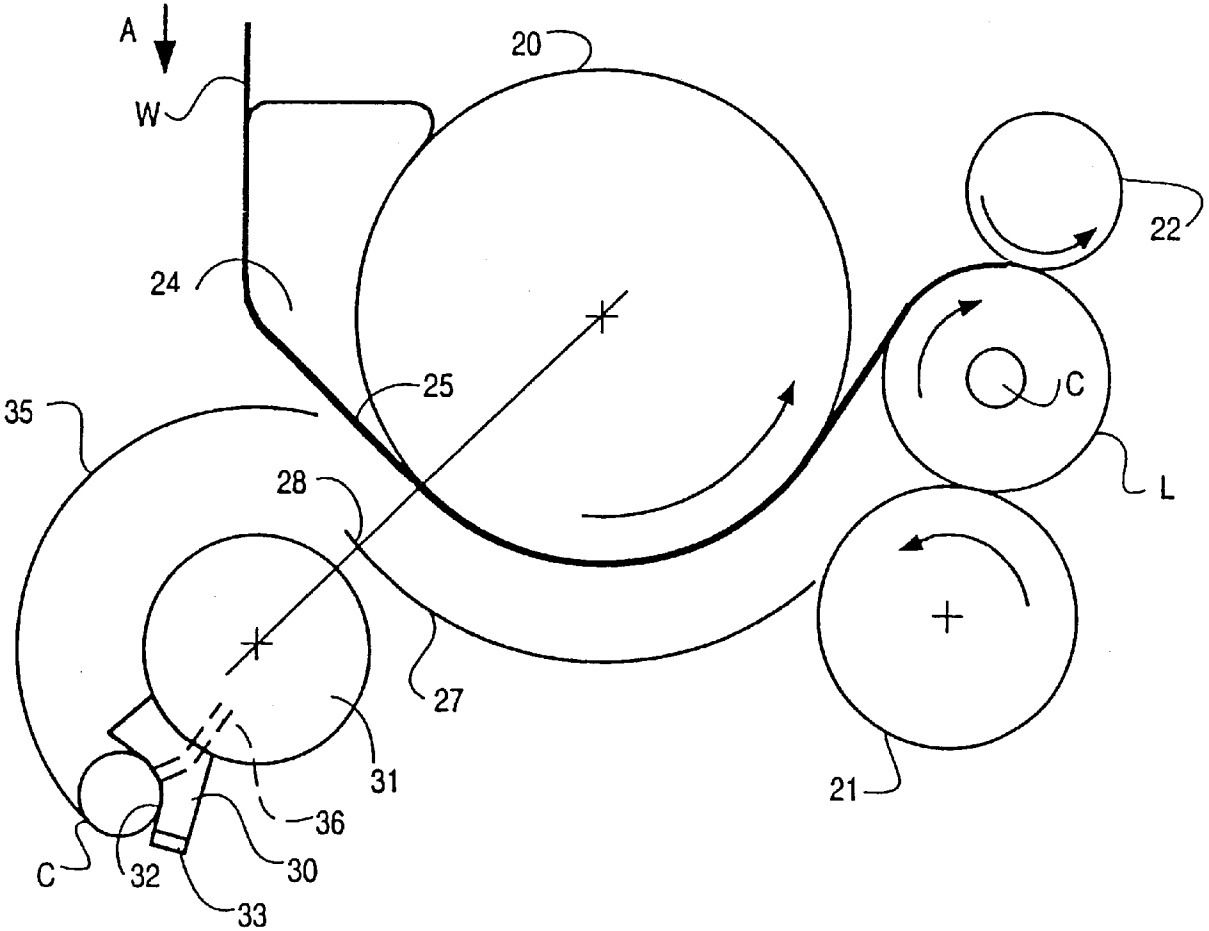
FIG. 1 illustrates a surface rewinder before a new core is inserted.

Referring to FIG. 1, a surface rewinder includes a conventional three roll winding cradle which includes a first or upper winding roll 20, a second or lower winding roll 21, and a rider roll 22. The rolls rotate in the direction of the arrows to wind a web W on a hollow cardboard core C to form a log L of convolutely wound paper such as bathroom tissue or paper toweling. The web is advanced in a downstream direction as indicated by the arrow A and is preferably transversely perforated along longitudinally spaced lines of perforation to form individual sheets.

The first winding roll 20 preferably has a uniform outer surface with a high coefficient of friction so that the web does not slip on the rotating roll. For example, the surface can be formed from 600 RA tungsten carbide which extends over the entire surface of the roll which engages the web. The first winding roll rotates at web speed.

The second winding roll 21 can be movably mounted on the rewinder so that the roll can move toward and away from the first winding roll as described in U.S. Pat. Nos. 4,828,195 and 4,909,452. The second winding roll can also have a variable speed profile as described in U.S. Pat. No. 5,370,335.

The rider roll 22 is pivotably mounted so that it moves away from the second roll as the winding log builds.

Before the web reaches the first winding roll 20, it travels over a stationary pinch bar 24 which is mounted adjacent the first winding roll. The pinch bar has a web-pinching surface 25 which has a relatively low coefficient of friction so that there is little or no drag on the web during normal winding. In one specific embodiment, the pinch bar surface 25 was formed from smooth steel.

A stationary plate 27 (also referred to as a transfer plate or dead plate) is mounted below the first winding roll 20 upstream of the second winding roll 21. The upstream end 28 of the stationary plate is spaced from the first winding roll a distance slightly greater than the diameter of the cores C. The spacing between the remainder of the stationary plate and the first winding roll is slightly less than the diameter of the cores so that the cores will be compressed slightly and will be rolled along the stationary plate by the rotating winding roll. The stationary plate preferably has a high friction surface, for example, tungsten carbide, in order to begin core rotation as soon as possible.

A pinch arm 30 is mounted on a rotatable shaft 31. Either a single pinch arm or a plurality of axially spaced pinch arms can be mounted on the shaft 31. The pinch arm includes a core-engaging surface 32 and a pinch pad 33. The pinch pad is preferably formed from compliant, compressible, resilient, high friction material such as 40 Shore A rubber or polyurethane. The pad may also have a high durometer surface on a low durometer base to decrease wear.

FIG. 1 illustrates the pinch arm in the process of advancing a core C along an arcuate core guide 35 toward the first winding roll 20 and the stationary plate 27. Circumferential rings of adhesive have already been applied to the core in the conventional manner. The pinch arm 30 and shaft 31 may be provided with a vacuum port 36 for holding the core against the pinch arm.

Figure 2:
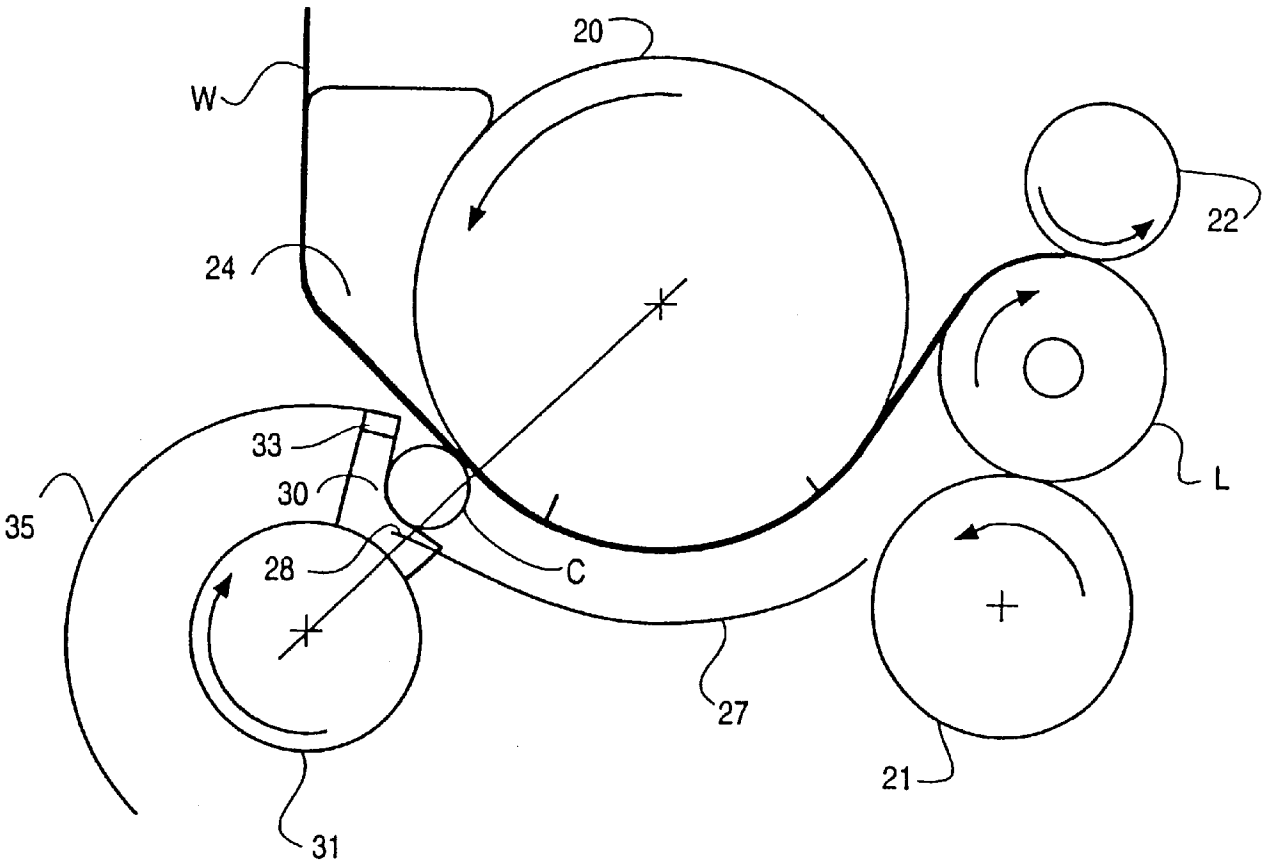
FIG. 2 shows the core and pinch pad just before the web is pinched.

FIG. 2 illustrates the pinch arm moving the core into the space between the upstream end 28 of the stationary plate and the first winding roll 20. The pinch pad has accelerated to about one-half of web speed. The core travels close to the web but does not pinch the web. The pinch pad 33 has not yet engaged the web, and the web continues to be wound on the log L.

Figure 3:
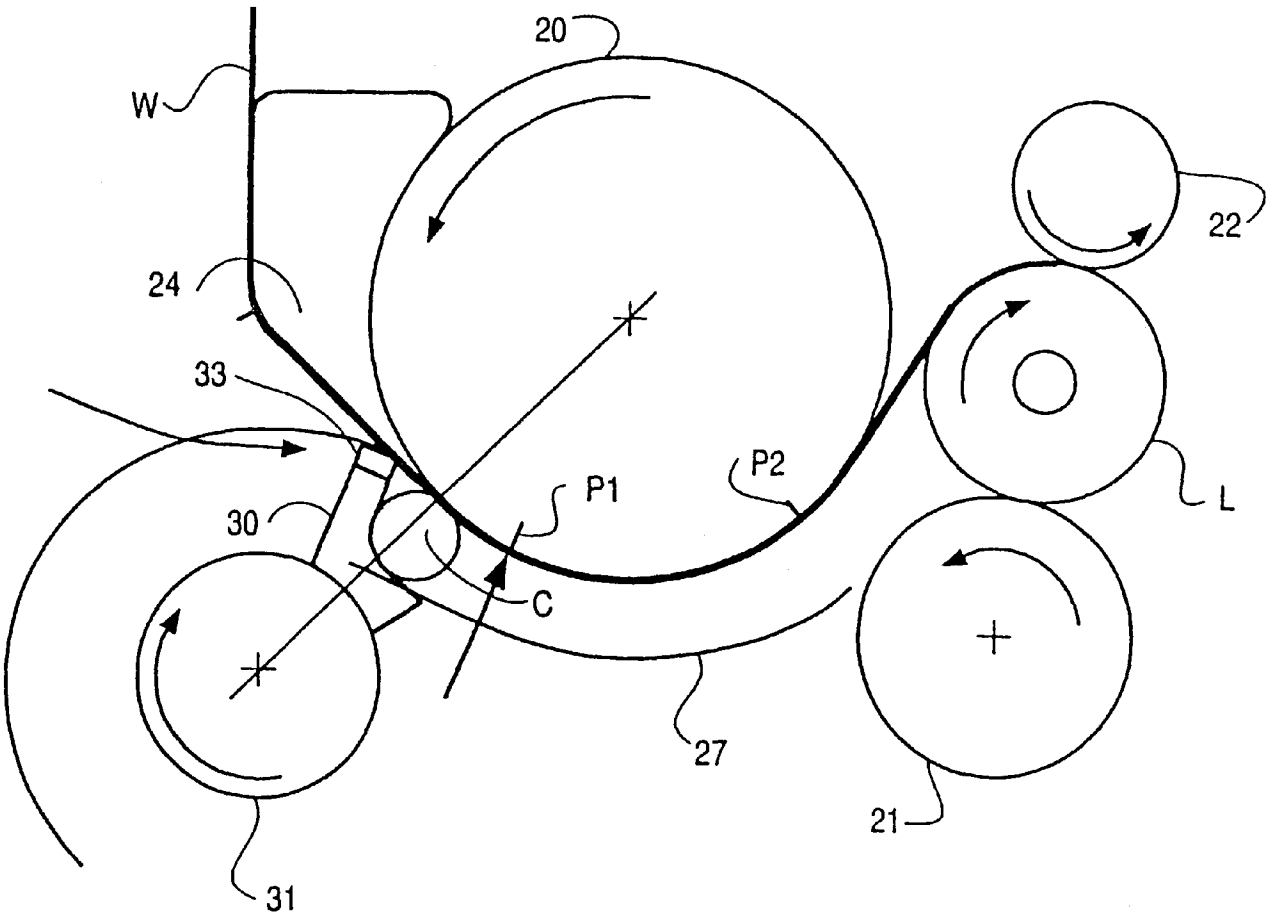
FIG. 3 shows the start of web pinch.

FIG. 3 illustrates the start of web pinch. The perforation $P_1$ which forms the last sheet to be wound on the log L in order to give a desired exact sheet count is represented by a hash mark and is located on the first winding roll just downstream of the core C. The previous perforation $P_2$ is also on the surface of the first winding roll. The pinch pad 33 begins to pinch the web W against the stationary pinch surface of the pinch bar 24.

Figure 4:
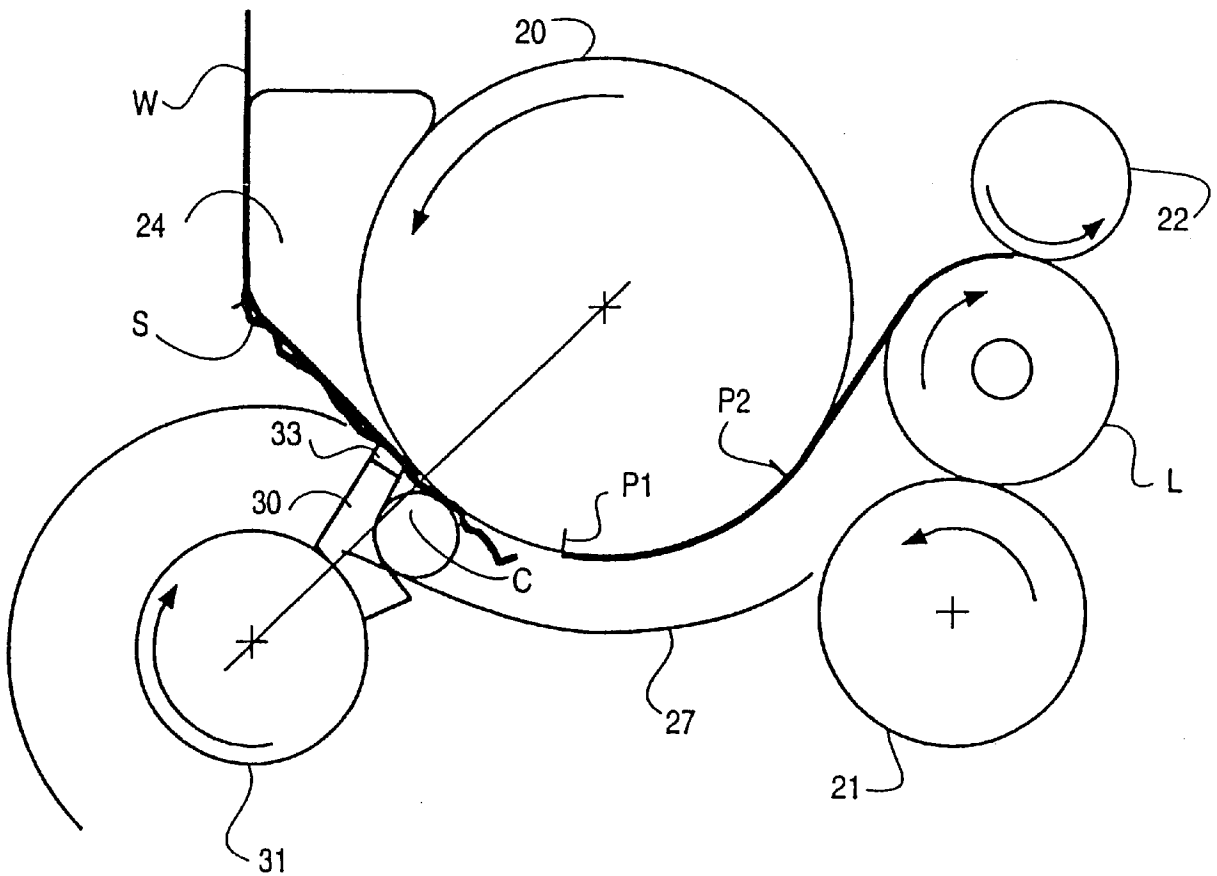
FIG. 4 shows web severance and transfer to a new core.

In FIG. 4 the pinch pad 33 continues to pinch the web against the pinch bar, and the web has been slowed down enough and stretched enough so that the web severs at the perforation $P_1$ which is closest to the pinch bar. Because of the high friction surface on the first winding roll 20, the web is not stretched to any significant extent between the perforations $P_1$ and $P_2$ Since the web has been slowed down at the pinch point, a small amount of slack S develops in the web upstream of the pinch bar.

Figure 5:
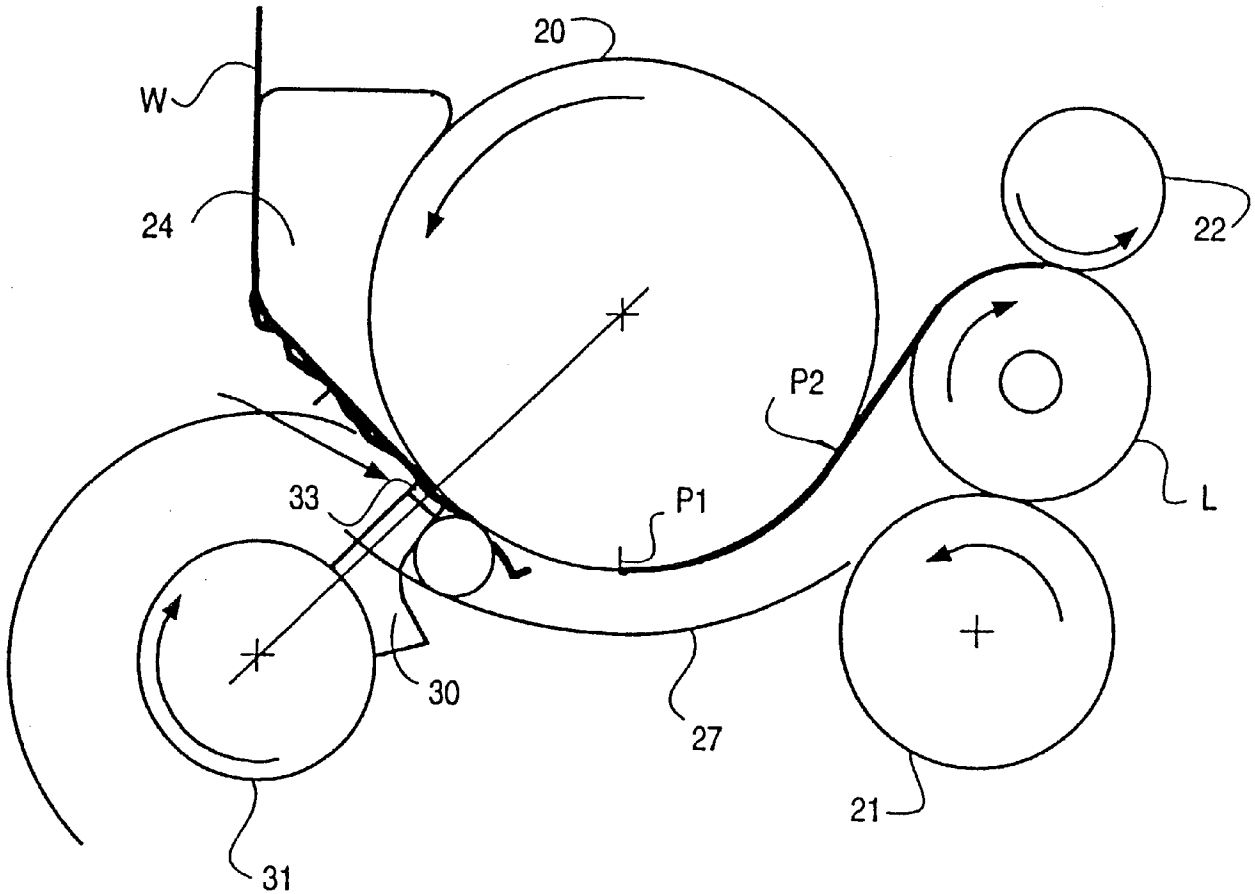
FIG. 5 shows the end of web pinch.

FIG. 5 illustrates the end of web pinch, and the pinch pad 33 is moving out of contact with the pinch bar 24. The web is preferably pinched for about ½ inch of web travel on the first winding roll. At a web speed of 3000 feet per minute, the duration of web pinch is about 0.0016 seconds. About ½ inch of elongation or stretch is imparted to the web between the pinch pad and the perforation $P_1$ which has been severed. The core C has been moved by the pinch arm along the stationary plate 27 to a position in which it is compressed by the first winding roll and begins to roll on the stationary plate. A high friction surface on the stationary plate will minimize slipping of the core and will ensure that the core begins rolling as soon as possible. The profile of the stationary plate is preferably such that the core will be pressed against the web and the first winding roll immediately after the web is severed.

Figure 6:
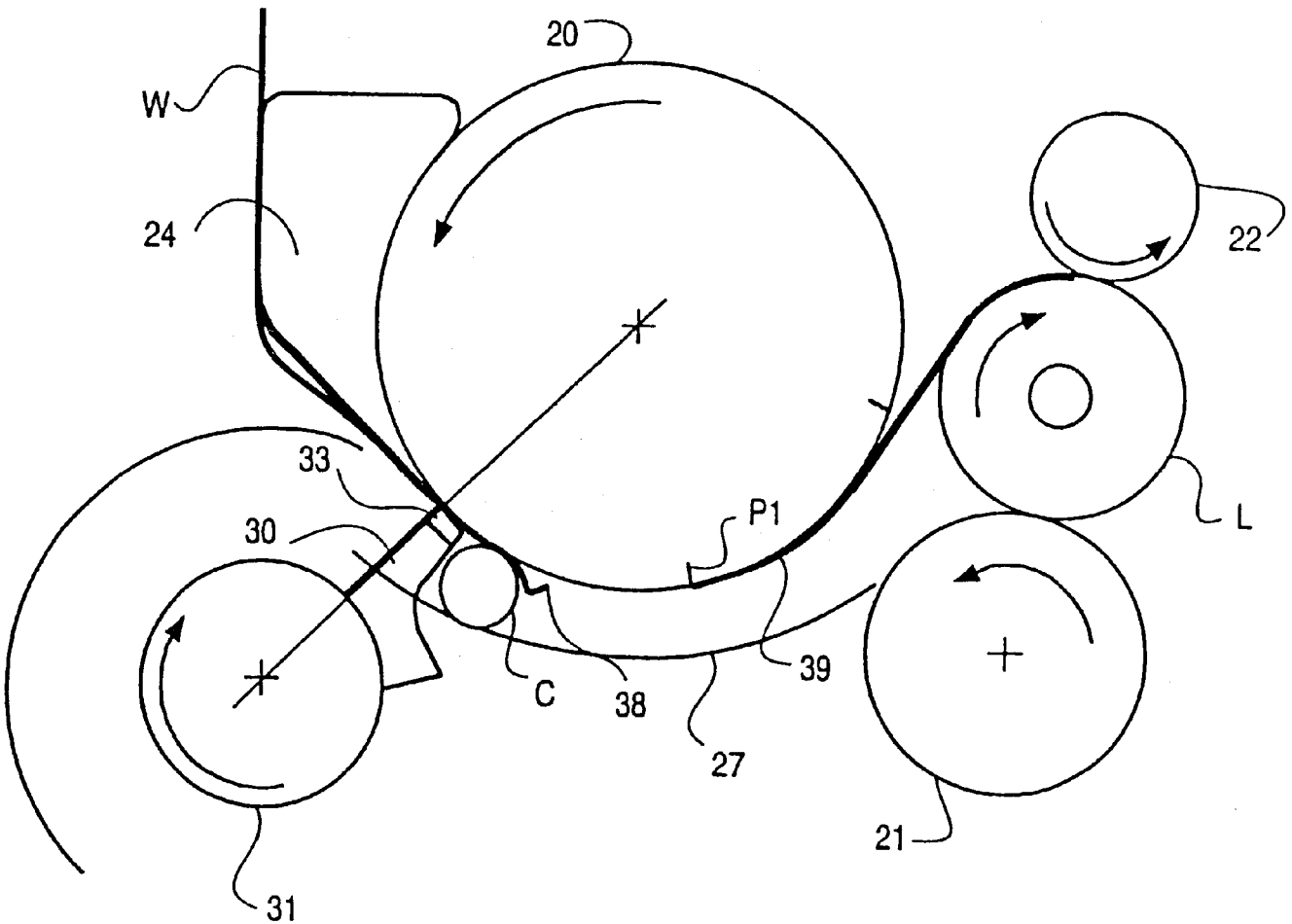
FIG. 6 shows the severed web being wrapped around a new core.

In FIG. 6 the core C continues to roll over the stationary plate. The rings of glue on the core pick up the severed web behind the leading portion 38 of the severed web so that the web begins to wind onto the core as the core rolls over the stationary plate. The tail 39 of the severed web downstream of the perforation $P_1$ continues to be rolled up onto the log L.

Figure 7:
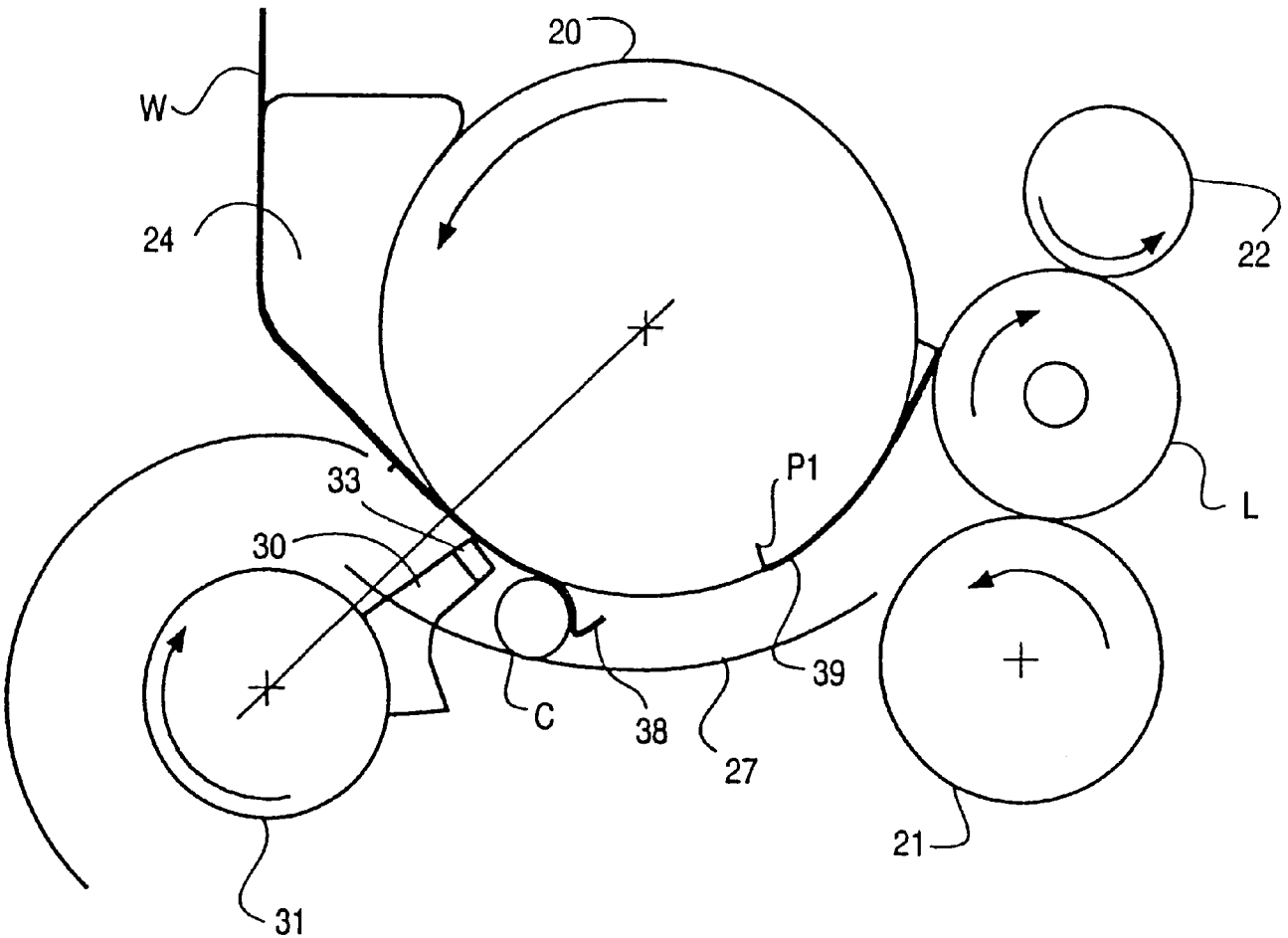
FIG. 7 shows the new core continuing to wrap the web.

In FIG. 7 the core has rolled farther along the stationary plate 27, and the leading portion 38 of the web folds back on the outside of the transferred web. The length of the foldback is determined by the position of the perforation $P_1$ at the time of transfer of the web to the glued core. The core continues to roll on the stationary plate and wind the web there around to begin a new log. When the core and the building log reach the second winding roll 21, the log is wound between the first and second winding rolls and is eventually contacted by the rider roll 22.

Figure 8:
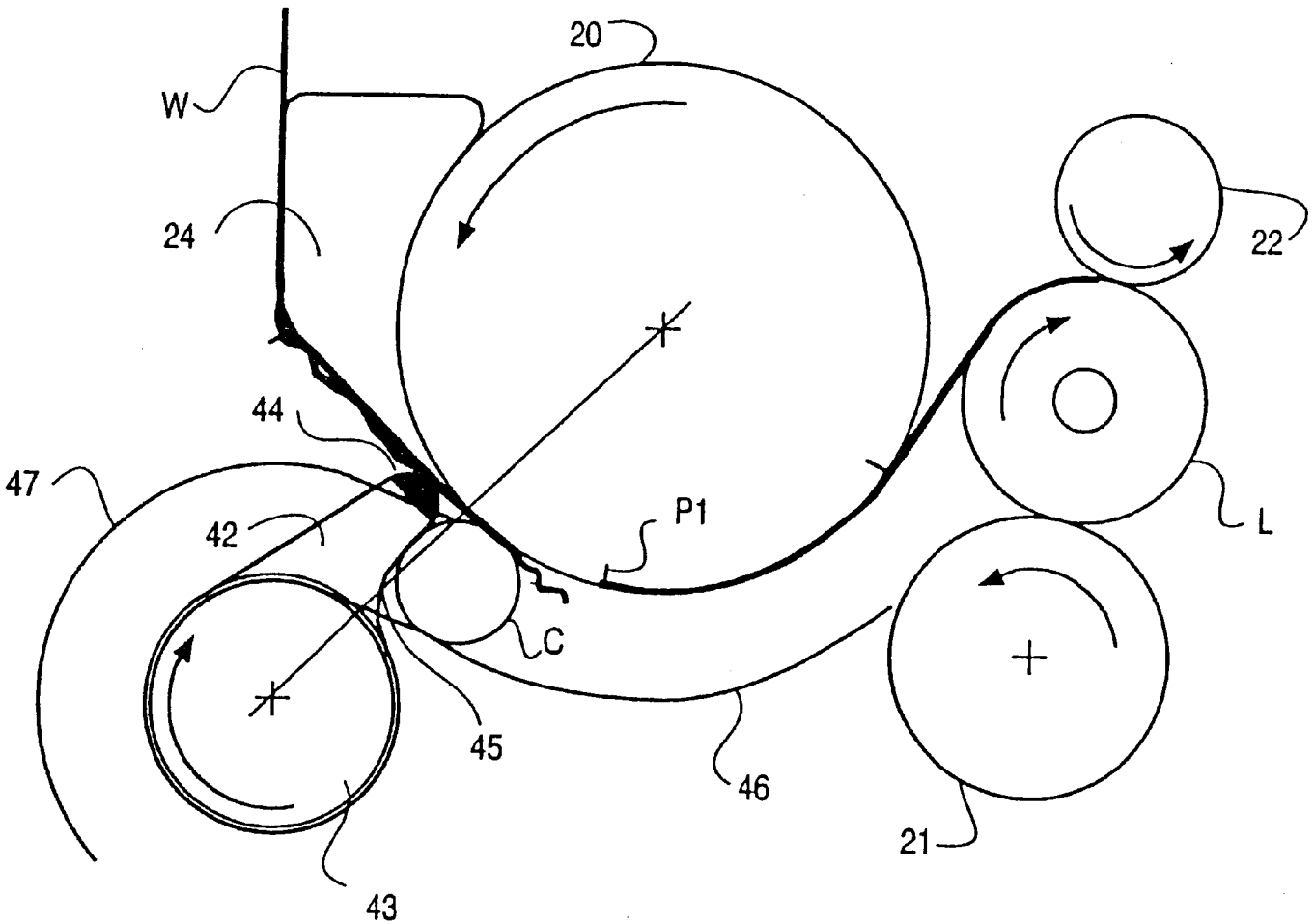
FIG. 8 illustrates a surface rewinder with a modified pinch arm.

A modified pinch arm 42 is illustrated in FIG. 8. A plurality of axially spaced pinch arms extend from a rotatable shaft 43, and a compliant, high friction pinch pad 44 is mounted on each pinch arm. A core-engaging surface 45 on each pinch arm advances a core C onto a stationary plate 46 as the pinch pad approaches the pinch bar 24. The pinch arms extend through slots in the core guide 47, and the pinch pads pinch the web against the stationary pinch bar to tension and sever the web at perforation $P_1$. The severed web is transferred to the core as the core begins to roll on the stationary plate, and the web is picked up by the glue on the core.

Figure 9:
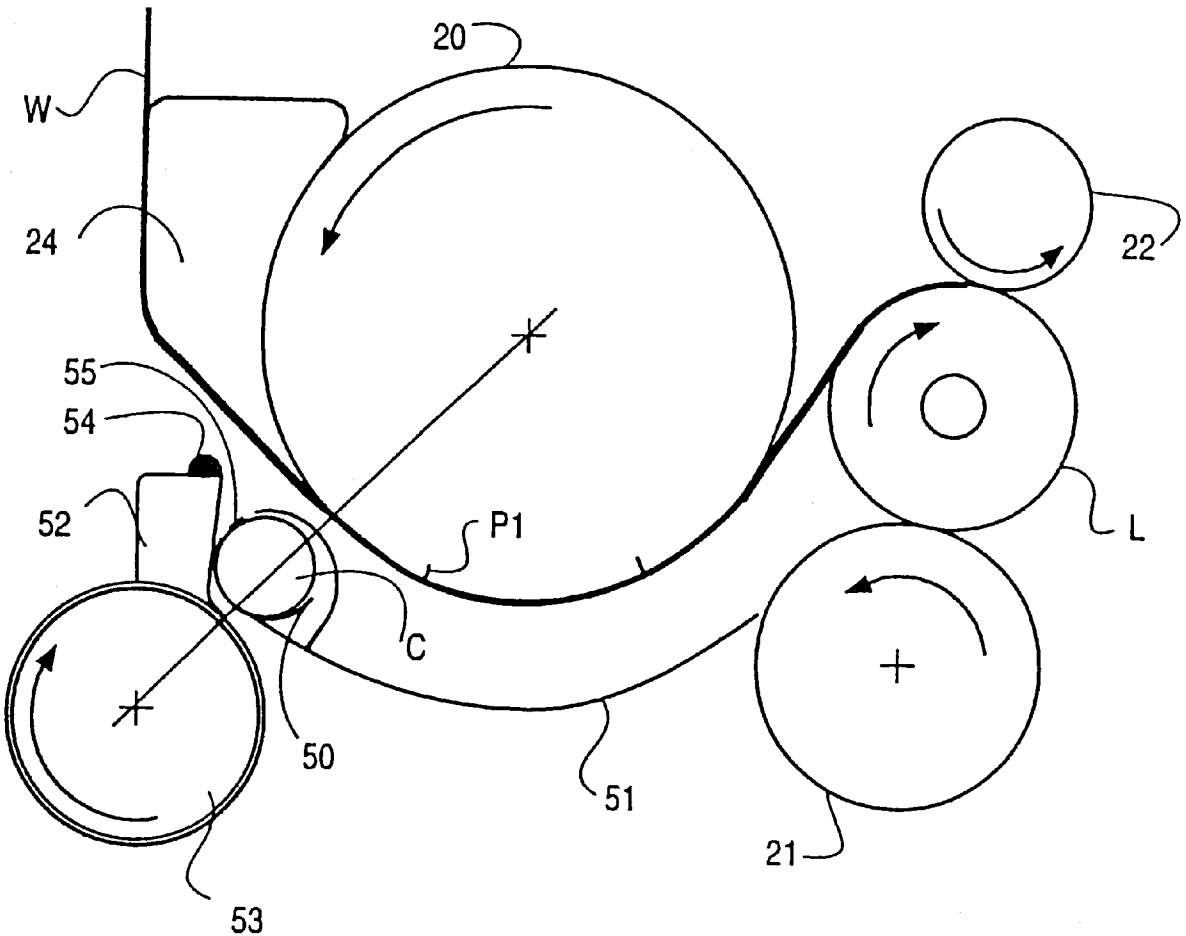
FIG. 9 illustrates another embodiment of a pinch arm and a spring retainer for the new core.

In FIG. 9 a new core C is held in a cradle-shaped spring retainer 50 at the upstream end of stationary plate 51. A plurality of axially spaced pinch arms 52 are mounted on shaft 53 and pass through slots in the retainer to push the core onto the stationary plate. The core flexes the end of the spring retainer downwardly as it exits the spring retainer.

A pinch pad 54 on each pinch arm pinches the web against stationary pinch bar 24 to sever the web at perforation $P_1$. The severed web is picked up by an axial glue line 55 on the core.

Figure 10:
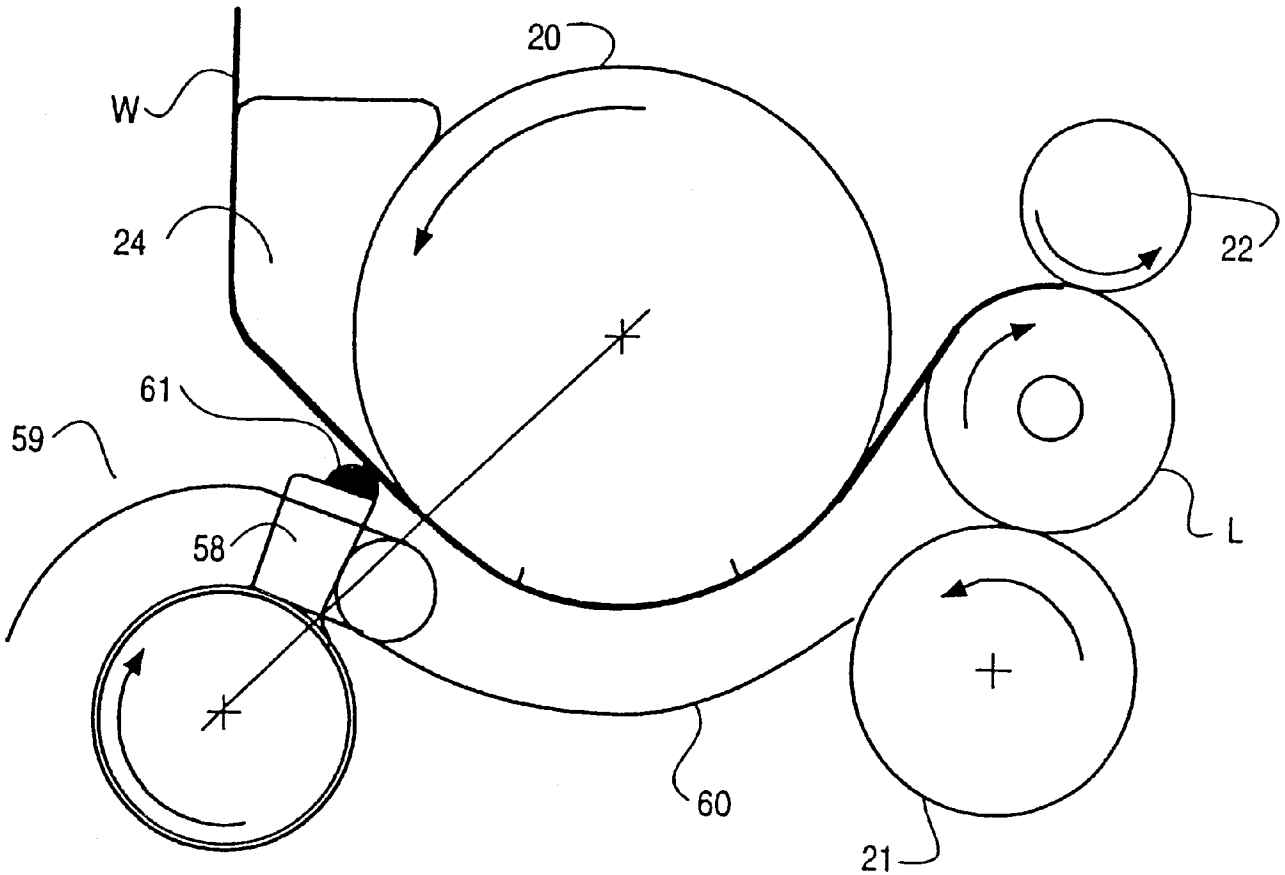
FIG. 10 illustrates the pinch arm of FIG. 9 with a different stationary plate.

FIG. 10 illustrates a pinch arm 58 which is similar to the pinch arm of FIG. 9. However, the spring retainer is omitted, and the core is advanced by the pinch arm along a core guide 59 to a stationary plate 60. A pinch pad 61 pinches the web against pinch bar 24 before the core contacts the web on the first winding roll 20.

Using the pinch arm to insert the core between the stationary plate and the first winding roll facilitates the proper timing between the severance of the web and the contact of the core with the web and simplifies the structure of the core insertion device. However, other means for inserting the core can be used. For example, the core can be inserted by a conveyor, a pusher, or other equivalent devices.

Figure 11:
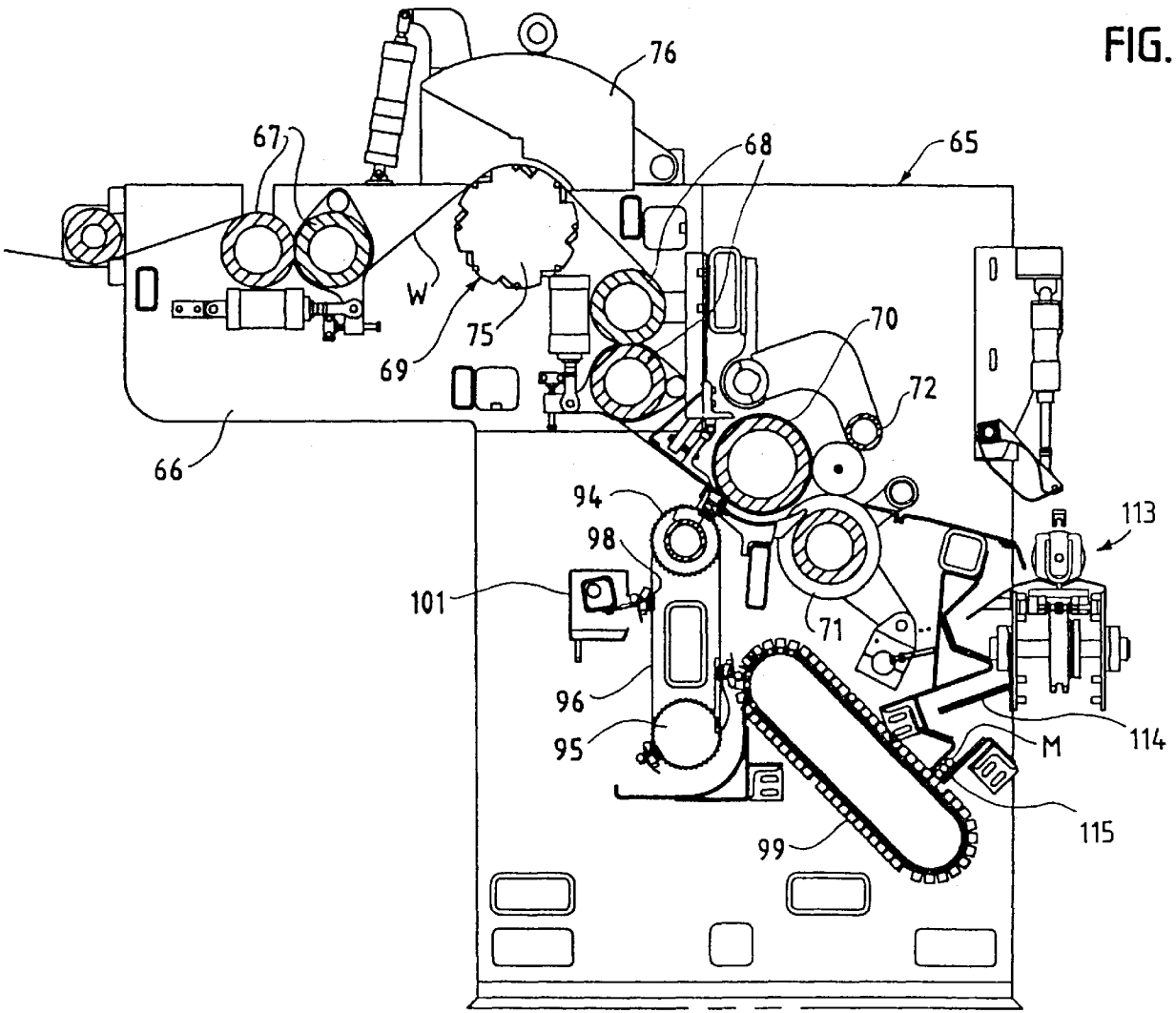
FIG. 11 illustrates a rewinder which winds the web on recycled mandrels.

FIG. 11 illustrates a complete rewinder apparatus 65 which is designed to wind the web on recycled, mandrels rather than cores. The mandrels can be either solid or hollow. In one embodiment, tubular steel mandrels were used. Solid plastic mandrels could also be used.

After a log is wound on a mandrel, the mandrel is stripped from the log to provide a coreless log having a center opening. The stripped mandrel is then recycled for additional winding cycles. U.S. Pat. No. 5,421,536 describes an apparatus for winding and recycling mandrels.

The rewinder 65 includes a frame 66 on which two pairs of draw rolls 67 and 68 are mounted. The draw rolls advance web W through a perforator 69 to a three roll winding cradle formed by a first winding roll 70, a second winding roll 71, and a rider roll 72. The perforator 69 includes a rotating perforator roll 75 and a knife bar or anvil 76 for forming longitudinally spaced transverse lines of perforation in the web.

Figure 12:
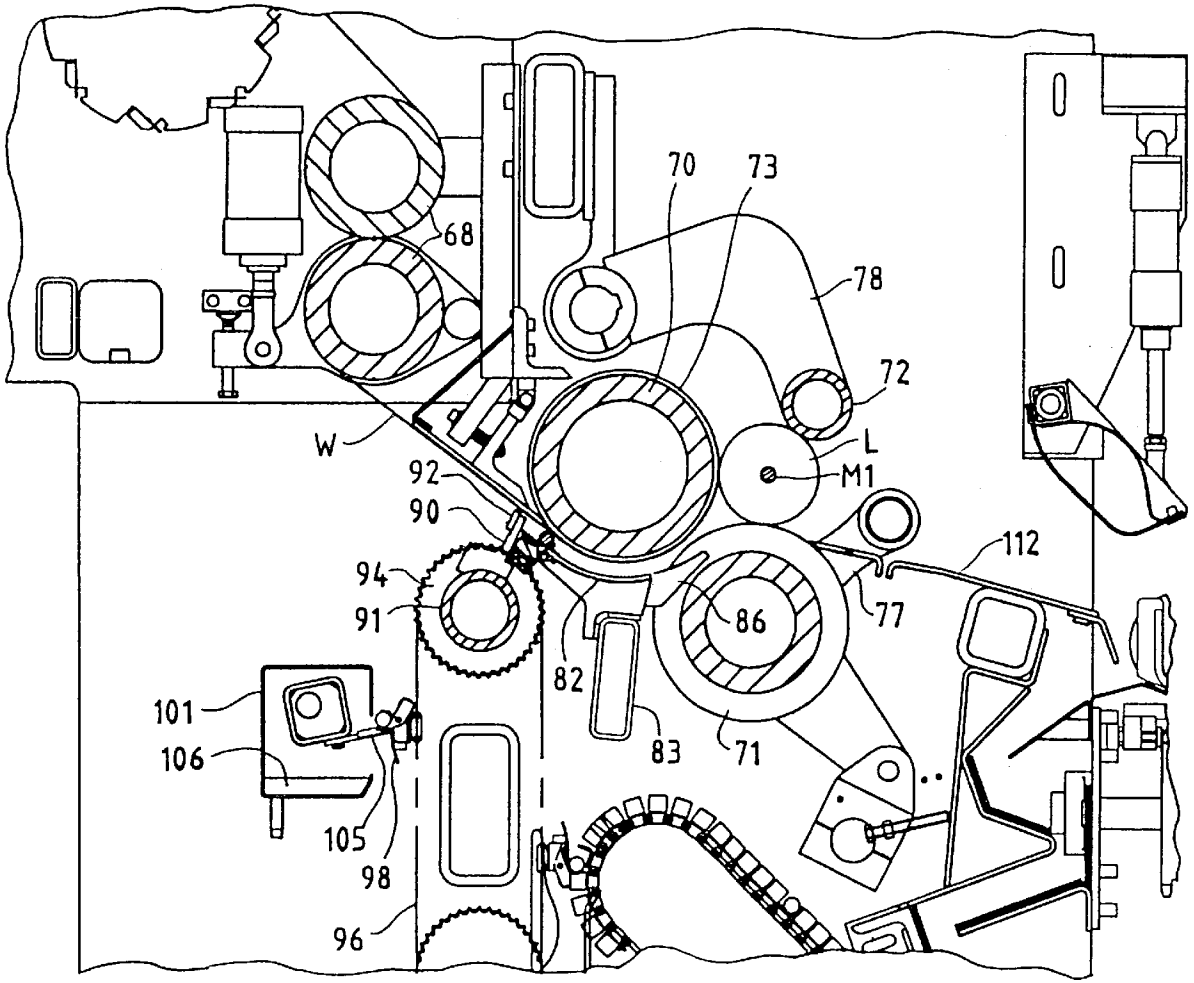
FIG. 12 is an enlarged view of the three roll winding cradle of FIG. 11.

Referring to FIG. 12, the first winding roll includes a compliant, compressible, resilient outer layer 73 which has a relatively high coefficient of friction. The outer layer can be formed from tape which is wrapped around the roll or from rubber or polyurethane. The second winding roll 71 has a smooth outer surface, and the rider roll 72 has a rough surface with a high coefficient of friction. The first winding roll is rotatably mounted in the frame on a fixed axis. The second winding roll 71 is mounted on a pivot arm 77, and the rider roll 72 is mounted on a pivot arm 78. A log L is being wound on a mandrel $M_1$.

The web travels from the draw rolls 68 over a pinch bar 80 which is mounted on the frame upstream of the first winding roll 70. The pinch bar has a smooth, low friction surface. If desired, the pinch bar can be positioned so that the web does not contact the pinch bar during normal winding.

A curved stationary plate 82 is mounted below the first winding roll 70 on a bar 83 on the frame. The stationary plate includes an upstream portion 84 on which is mounted a pad 85 (FIGS. 13 and 14) and axially spaced fingers 86 which extend into grooves 87 in the second winding roll. The pad 85 is formed from compliant, compressible, resilient material such as smooth rubber or smooth polyurethane. It may be advantageous if the surface of the pad 85 has a relatively high coefficient of friction for initiating core rotation. The fingers 86 have a smooth surface.

A pinch arm 90 is mounted on a shaft 91 which is rotatably mounted on the frame. A pinch pad 92 is mounted on the pinch arm and extends beyond the end of the pinch arm. The pinch pad is formed from compliant, compressible, resilient high friction material such as rubber or polyurethane.

Figure 13:
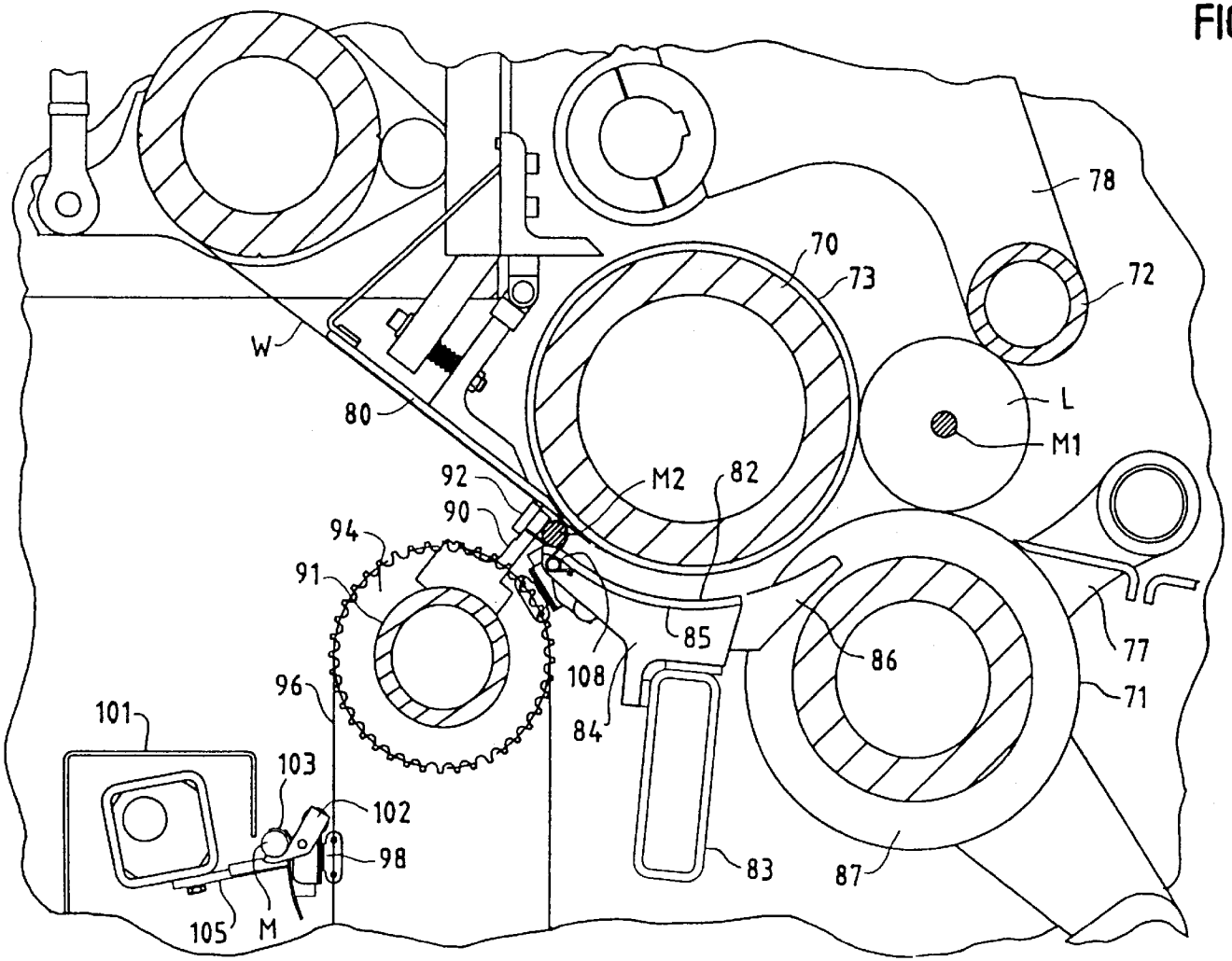
FIG. 13 illustrates the rewinder of FIG. 11 as the web is pinched and severed.

Returning to FIG. 11, upper and lower sprockets 94 and 95 are rotatably mounted on the frame, and a chain 96 is driven by the sprockets. A plurality of mandrel carriers 98 are mounted on the chain 96 for picking up mandrels M from a mandrel conveyor 99 and for transporting the mandrels past a transfer glue applicator 101 to a mandrel insertion position at the upstream end of the stationary plate 82 (FIG. 13). Each mandrel carrier includes a pair of pivoting jaws 102 and 103 (FIG. 13) for holding a mandrel.

The glue applicator 101 includes a pivoting arm 105 (FIG. 12) which is dipped into a bath of transfer adhesive 106 and applies an axial line of transfer adhesive to the mandrel. The adhesive is a relatively low tack adhesive so that the mandrel can be stripped from the wound log, but the adhesive has sufficient tack to transfer the web to the mandrel.

Referring to FIG. 13, the mandrel carrier deposits a glued mandrel $M_2$ on the upstream end of the stationary plate 82 where it is held by a mandrel retainer spring 108 which is mounted on the stationary plate. The mandrel does not contact the web when it is held by the retainer spring. The glue line on the mandrel is positioned at about 12:00 o'clock in FIG. 13.

When the perforation for the last sheet for the winding log L is just downstream of the mandrel $M_2$, the rotation of the shaft 91 causes the pinch pad 92 to pinch the web against the stationary pinch bar 80. Although the pinch pad is moving in the same direction as the web, the pinch pad is moving at a slower speed than the web, preferably at about ½ of web speed. The web is therefore slowed down by the pinch pad. The pinch pad continues to pinch the web as the pinch arm 90 rotates, and the web is tensioned and stretched so that it severs at the desired perforation to form a leading edge 110 as shown in FIG. 13.

Figure 14:
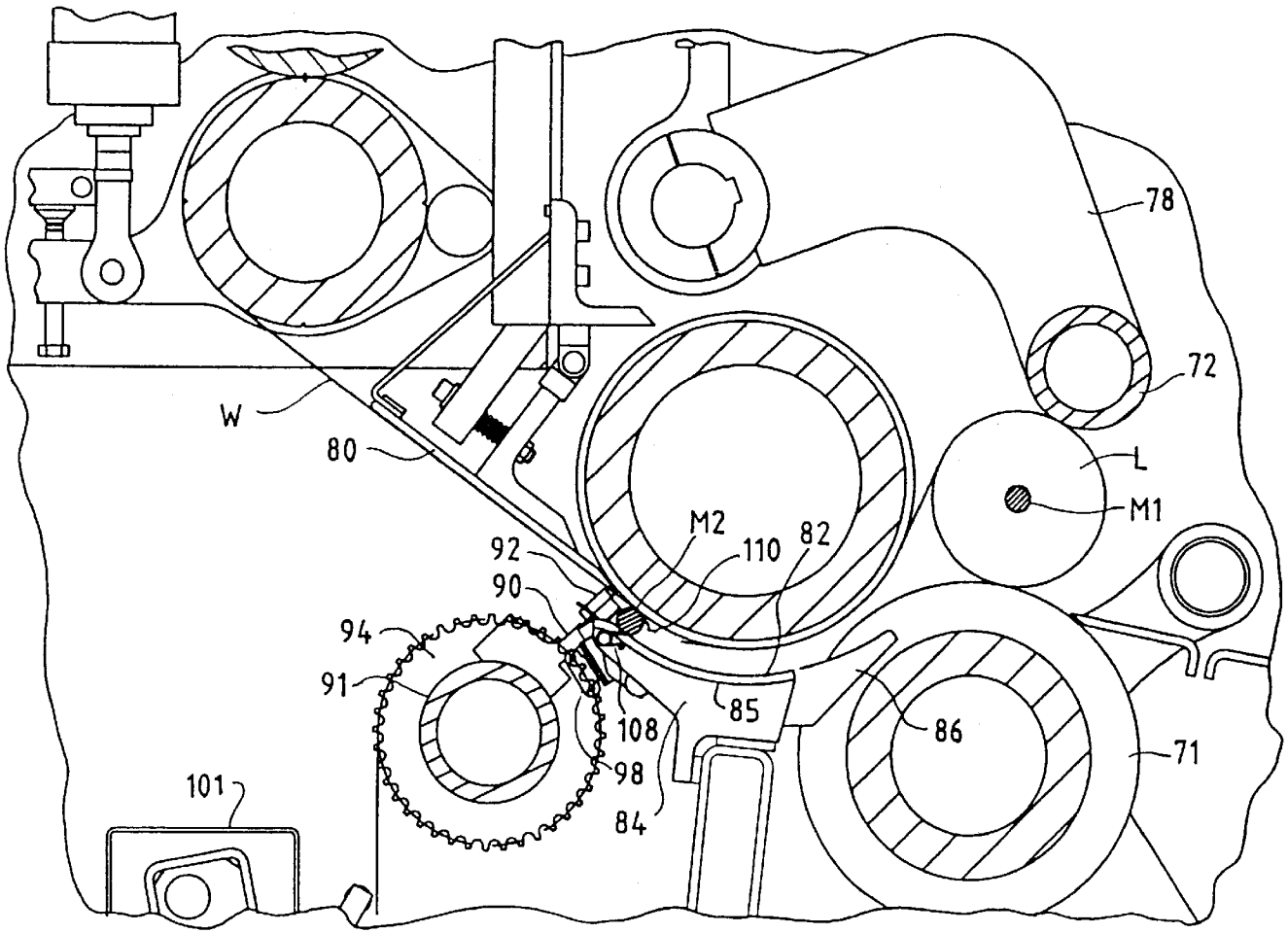
FIG. 14 illustrates transferring the web to a mandrel.

Rotation of the pinch arm 90 also moves the mandrel $M_2$ past the retainer spring 108 (FIG. 14) so that the mandrel contacts the web and begins to roll on the stationary plate 82 under the influence of the first winding roll 70. Even though the mandrel is solid, the mandrel can be inserted between the first winding roll and the stationary plate because of the compliant layers 73 and 85. As the mandrel rolls, the line of glue on the mandrel picks up the web slightly upstream of the leading edge, and the web is transferred to the mandrel as shown in FIG. 14.

As is well known in the art, the speed of either or both of the second winding roll 71 and the rider roll 72 is changed at an appropriate time so that the winding log L moves past the lower winding roll 71 and the rider roll 72 and down the exit ramp 112. The mandrel is thereafter stripped from the wound log by a mandrel stripper assembly 113 (FIG. 11), and the stripped mandrel is returned by means of a chute 114 to a mandrel hopper 115 where the recycled mandrels are picked up by the mandrel conveyor 99.

Referring again to FIG. 14, the mandrel $M_2$ which forms the new log continues to roll over the compliant pad 85 and contacts the fingers 86. By that time the web which is wrapped around the mandrel provides sufficient compliance so that the fingers need not be covered with compliant material. The second winding roll 71 has already begun to move away from the first winding roll 70 to permit the mandrel and the building log to roll through the nip between the two winding rolls.

Figure 15:
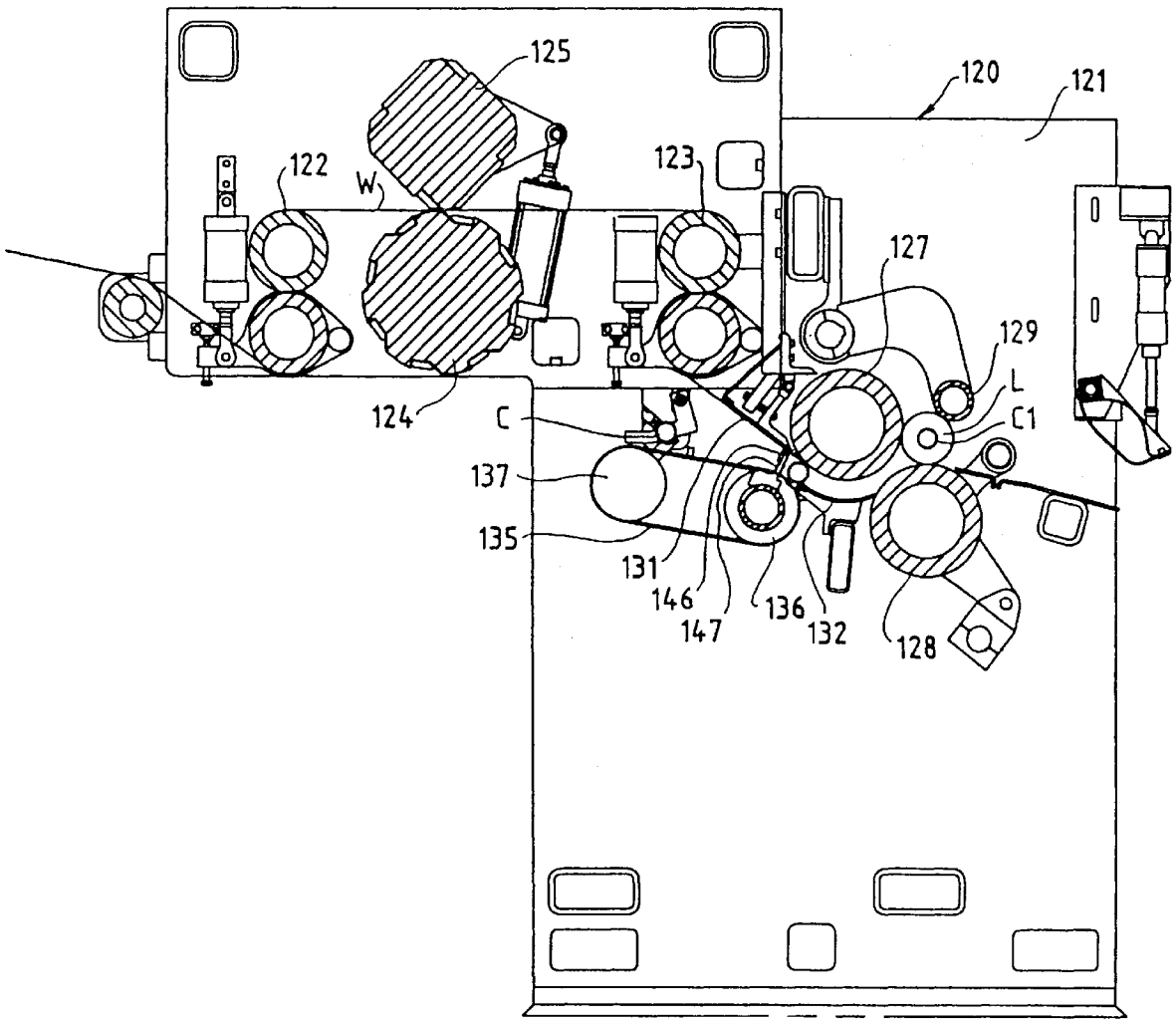
FIG. 15 illustrates a rewinder which winds the web on hollow cores.

FIG. 15 illustrates a complete rewinder apparatus 120 which is designed to wind the web on hollow cores C. The rewinder includes a frame 121 on which two pairs of draw rolls 122 and 123 are mounted. The draw rolls advance a web W past a rotating perforator roll 124 and a stationary knife bar 125 which form longitudinally spaced transverse lines of perforation in the web.

A log L is being wound on a hollow core $C_1$ in a three roll winding cradle formed by a first winding roll 127, a second winding roll 128, and a rider roll 129. The first winding roll 127 rotates on a fixed axis, and the second winding roll 128 and the rider roll 129 are pivotally mounted as previously described. The first winding roll and the rider roll each have a rough surface with a high coefficient of friction to the web.

The web travels from the draw rolls 123 over a pinch bar 131 which is mounted on the frame upstream of the first winding roll 127. The pinch bar has a smooth, low friction surface.

A curved stationary plate 132 is mounted below the first winding roll 127 and upstream of the second winding roll 128. The stationary plate is formed from sheet metal and has a smooth surface. For example, the stationary plate can be formed from steel with 125 micro inch finish. However, it may be advantageous to provide at least the upstream portion of the stationary plate with a high friction surface for the purpose of initiating core rotation. Cores are delivered to the transfer plate by a core conveyor 135 which is entrained on pulleys 136 and 137.

Figure 16:
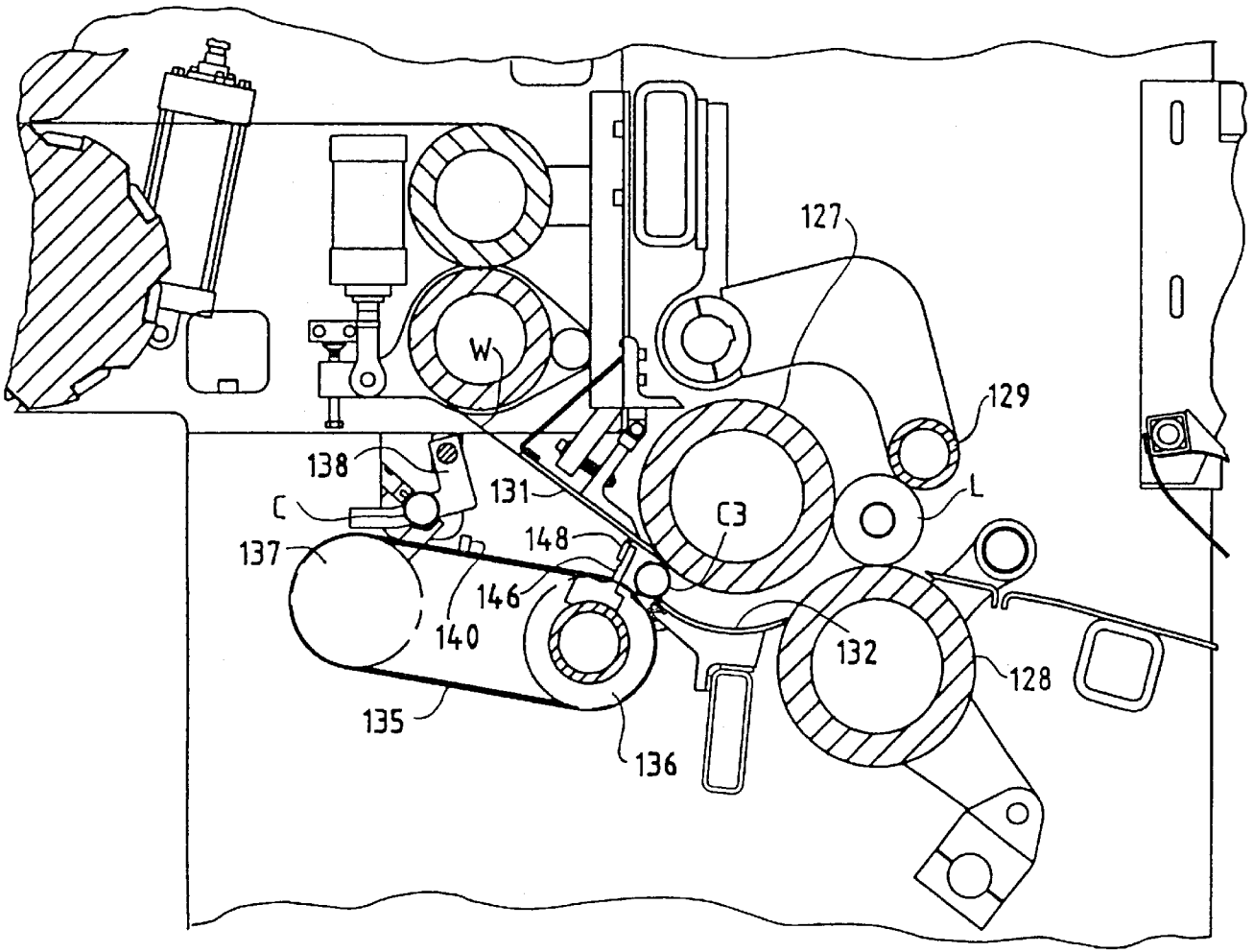
FIG. 16 is an enlarged view of the three roll winding cradle of FIG. 15.
Figure 17:
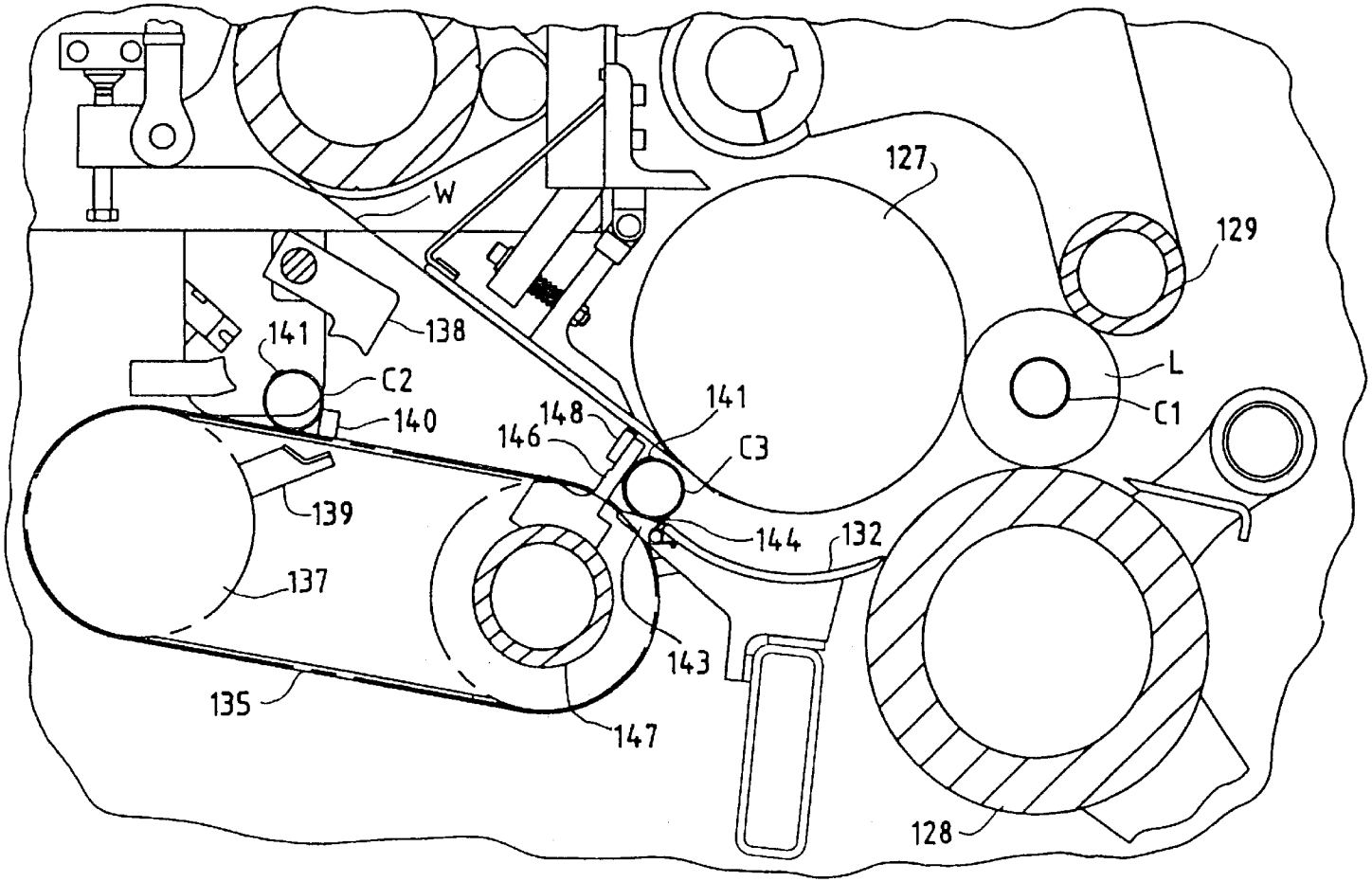
FIG. 17 illustrates the rewinder of FIG. 15 as the web is pinched and severed.

Referring to FIGS. 16 and 17, a core $C_2$ is retained above the core conveyor by a pivoting arm 138. When the arm 138 pivots to release the core, the core is carried to the conveyor 135 by a core support guide 139 which rotates with the pulley 137. A retaining bar 140 on the conveyor prevents the core from rolling as it is conveyed on the core conveyor toward the stationary plate. A line of adhesive 141 was previously applied to the core by an adhesive applicator.

The conveyor 135 deposits the core on an upstream holding portion 143 of the stationary plate 132 where it is retained by a core retaining spring 144 (FIG. 17). FIG. 17 illustrates a core $C_3$ in the holding position. The core $C_3$ does not contact the web in the holding position.

A plurality of axially spaced pinch arms 146 are mounted on a shaft 147 which is rotatably mounted on the frame. A pinch pad 148 is mounted on the pinch arm and extends beyond the end of the pinch arm. The pinch pad is formed from compliant, compressible, resilient, high friction material of the same type which was previously described.

Figure 18:
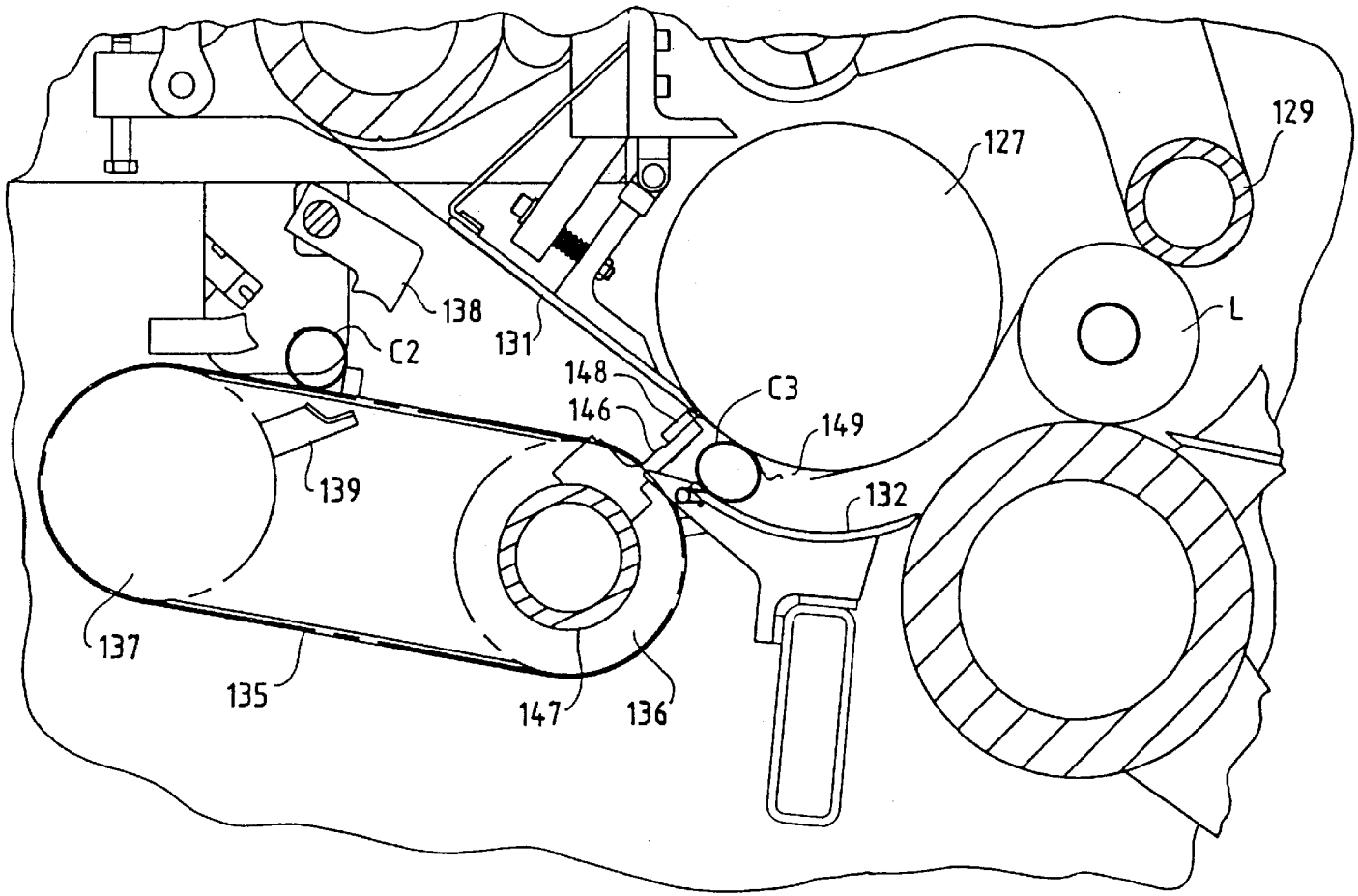
FIG. 18 illustrates transferring the web to a core.

When the perforation for the last sheet for the winding log L is just downstream of the core $C_3$ the rotation of the shaft 147 causes the pinch pad 148 to pinch the web against the stationary bar 131 to tension and sever the web at the desired perforation to form a leading edge 149 (FIG. 18). Rotation of the pinch arm 146 also moves the core $C_3$ past the retainer spring 144 so that the core contacts the web and begins to roll on the stationary plate 132 under the influence of the first winding roll 127. The stationary plate 132 and the holding portion 143 thereof can be provided with slots to permit the axially spaced pinch arms 146 to pass therethrough. As the core rolls on the stationary plate, the line of glue on the core picks up the web slightly upstream of the leading edge 149 of the web, the web is transferred to the core, and the leading end portion of the web folds back over the outside of the glued portion of the web portion.

As is well known in the art, the core $C_3$ which begins a new log can move through the nip between the first winding roll 127 and the second winding roll 128 by moving the second winding roll away from the first winding roll and/or changing the speed of the second winding roll relative to the speed of the first winding roll.

Figure 19:
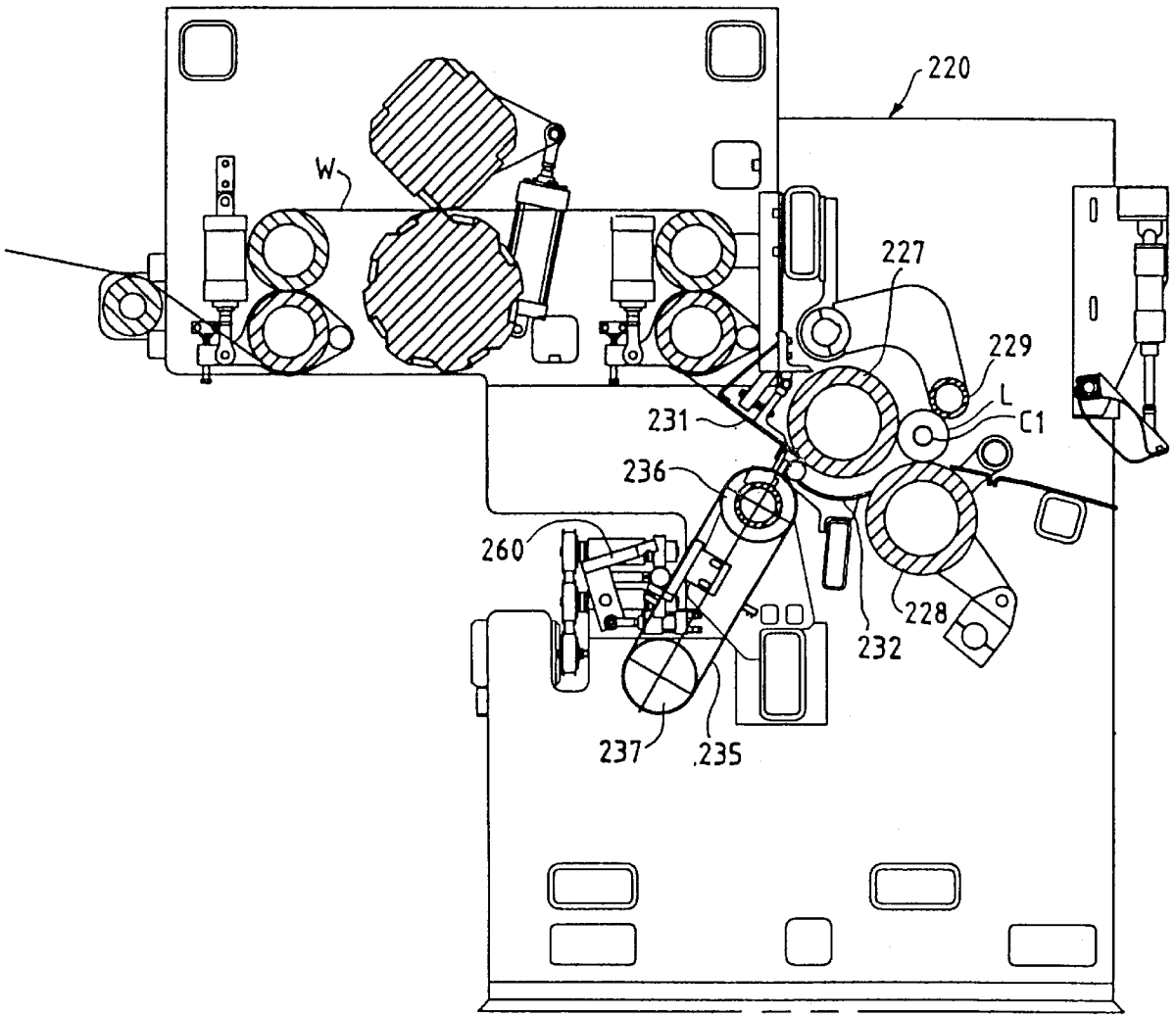
FIG. 19 illustrates a rewinder similar to the rewinder of FIG. 15 with a modified core delivery mechanism.

FIG. 19 illustrates a rewinder 220 which is similar to the rewinder 120 of FIG. 15 but which includes a modified core delivery mechanism. The reference numerals for the parts of rewinder 220 which are similar to the parts of rewinder 120 will be increased by 100.

Figure 20:
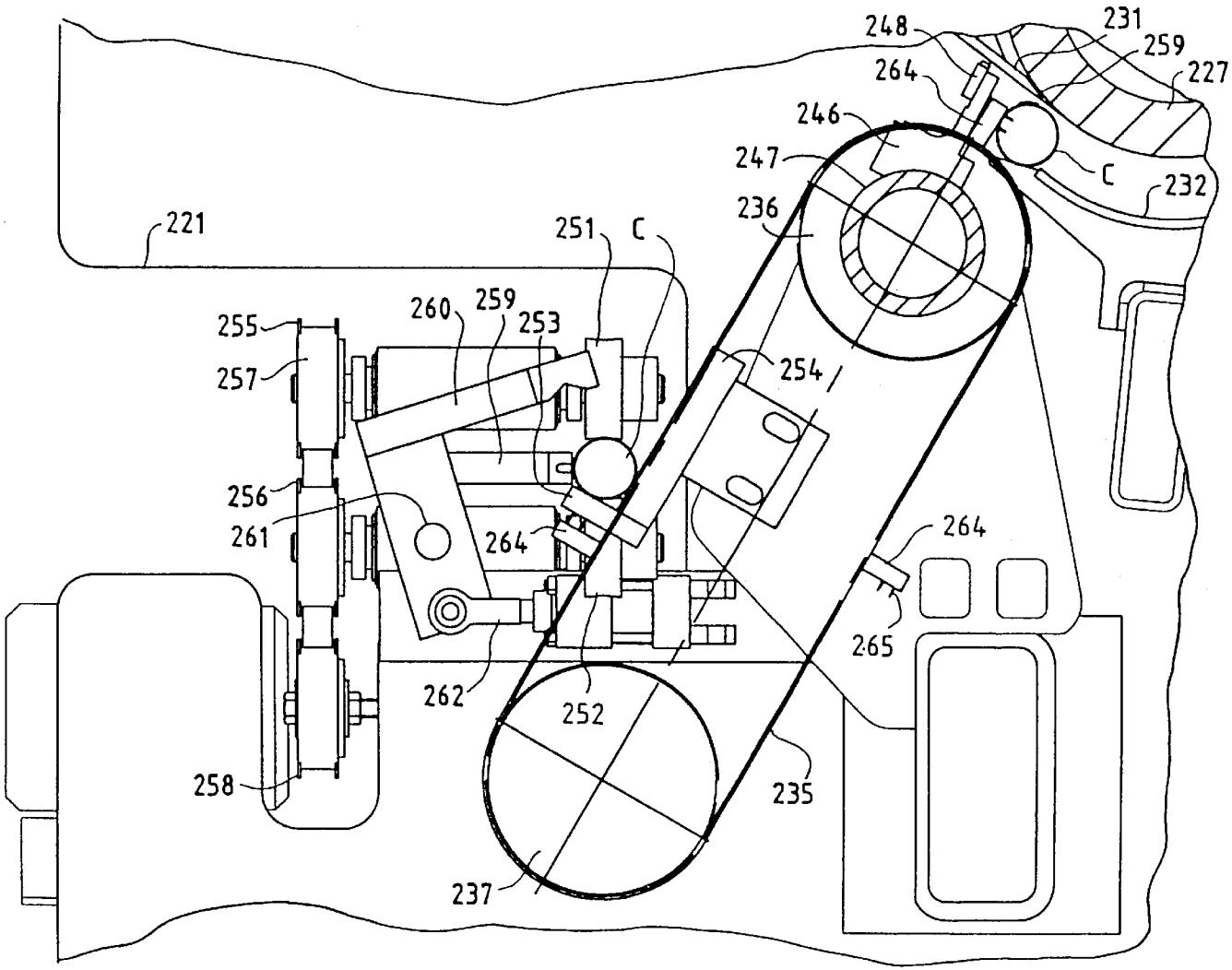
FIG. 20 is an enlarged fragmentary view of the core delivery mechanism of FIG. 19.

A core conveyor 235 is entrained on pulleys 236 and 237. The conveyor is inclined upwardly and extends past top and bottom core infeed wheels 251 and 252 (see also FIGS. 20 and 21). The core infeed wheels rotate to move a core C axially into a position where it is adjacent the conveyor 235 and is supported by a stationary core support 253 which is mounted on frame 221. The conveyor 235 can be provided by a plurality of axially spaced belts, and the core support 253 can be provided by a plurality of fingers which extend through the spaces between adjacent belts and which are supported by a mounting plate 254 on the frame of the rewinder.

The core infeed wheels 251 and 252 are driven by pulleys 255 and 256 which are driven by a belt 257 which extends around a drive pulley 258. As the core is moved axially by the core infeed wheels, a glue applicator 259 applies an axial strip of glue (FIG. 20) on the core.

After the core is positioned on the core supports 253, the core is held against the supports by pivotable arms 260. The pivotable arms 260 are mounted on a pivot pin 261 and are pivoted by a reciprocable ram 262. The arms 260 are mounted between the conveyor belts.

A plurality of core pushers or guides 264 are mounted on each of the conveyor belts 235 for movement with the conveyor belts, and one or more pins 265 are mounted on each core pusher.

Figure 21:
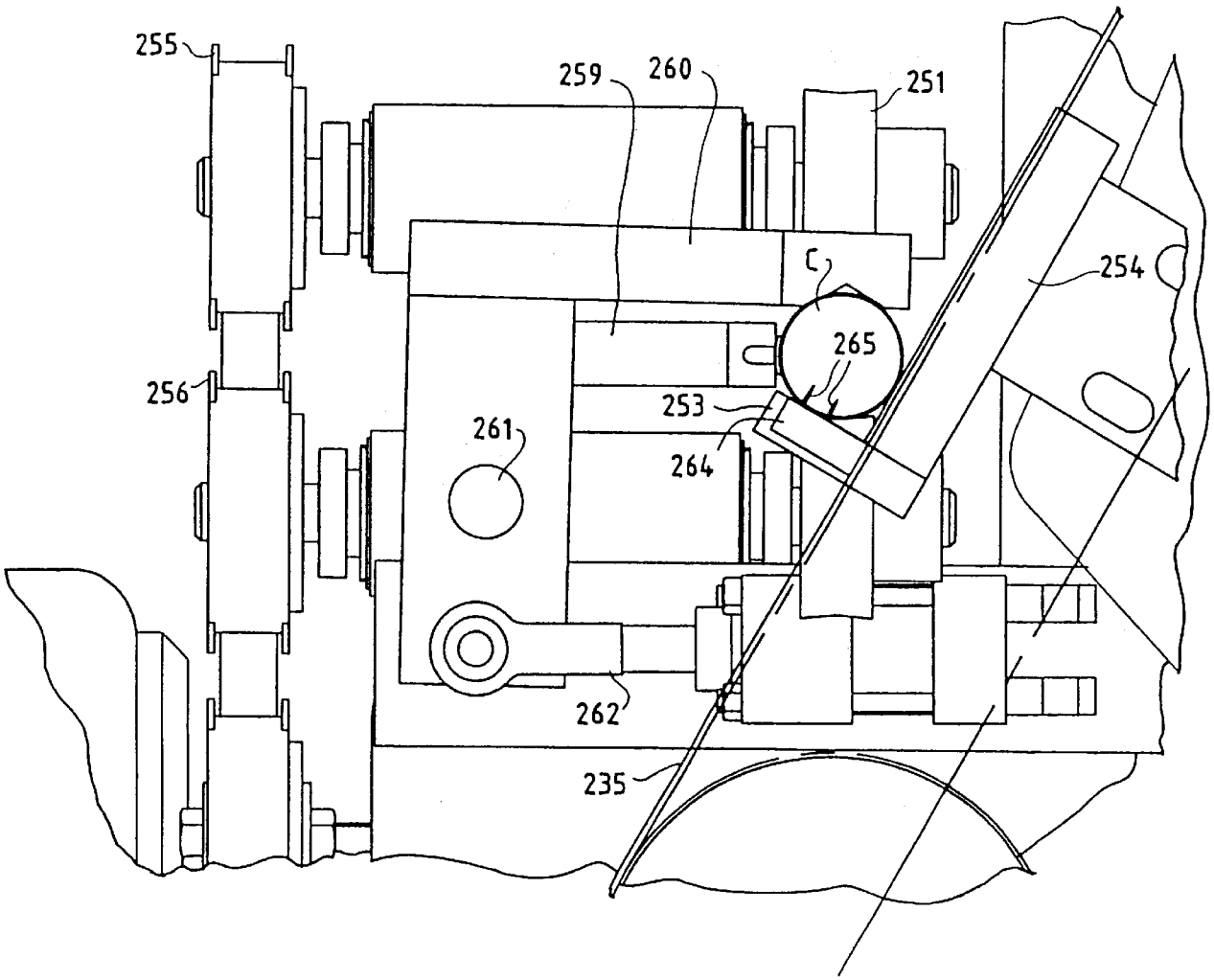
FIG. 21 is an enlarged fragmentary view of a portion of FIG. 20.

Referring to FIG. 21, as the conveyor belts advance the core pushers 264 upwardly toward the core C which is held between the core supports 253 and the pivot arms 260, the pins 265 on the core pushers engage and pierce the core. The pivot arms 260 are then pivoted to release the core, and the core pushers 264 carry the core upwardly toward the core insertion position illustrated in FIG. 20 between the stationary plate 232 and the first winding roll 227. When the core reaches the insertion point illustrated in FIG. 20, the conveyor belts 235 dwell so that the core C is held at the insertion point by the pins 265. The pins hold the core in the correct position and orientation so that the glue line is maintained in the proper position to engage the web immediately after the core contacts the web.

When it is time for the web to be severed, the shaft 247 is rotated to move the pinch arm 246 and the pinch pad 248 into position to pinch the web against the pinch plate 231. Continued rotation of the pinch arm 246 causes the pinch arm to engage the core C and move the core away from the pins 265 and into the nip between the first winding roll 227 and the stationary plate 232.

The invention can be used to wind a web on either a hollow paper core, a recycled mandrel, or other type of "center member".

The timing of the devices for introducing the cores or mandrels to the stationary plate and the timing and speed of the rotating pinch arms can be accurately controlled in a manner well known in the art by microprocessors and servo motors. The timing of the web pinch can be precisely controlled so that the web is severed at the desired perforation to give each log an exact sheet count. The duration of the pinch can also be accurately controlled to provide minimal slack. Minimizing slack improves transfer, fold-back of the web, and decreases wrinkling.

In the foregoing embodiments, the relative speed difference between the pinch pad and the first winding roll stretches the web and causes web separation. The high friction pinch pad pinches the web against a low friction pinch bar. The speed difference must be great enough over the duration of pinch to overcome the stretch limit of the web. This will limit the uppermost speed at which the pinch pad and core insertion operate relative to web speed. The surface speed of the pinch pad can be within the range of 10% to 80% of web speed.

If the materials were reversed, i.e., a low friction pinch pad and a high friction pinch bar, the web would go to zero speed for the duration of the pinch. This is described in U.S. Pat. No. 4,723,724. The high friction surface could be a resilient material (such as polyurethane) in a narrow strip, e.g., ¼ inch wide in the machine direction.

Unlike U.S. Pat. No. 4,723,724, the pinch duration could be made very short by the speed of the pinch pad and the width of the friction strip on the pinch bar. Secondly, the core or mandrel could be made to contact the web and winding roll immediately after the pinch to minimize the slack in the leading edge of the web. The surface speed of the pinch pad could be between 50% and 120% of web speed.

The advantage would be to have the insert speed of the core be equal to the web speed at the point where they first contact at the surface of the first winding roll. The core would then drop in translation speed and pick up rotational speed as it came under the influence of the transfer plate and the first winding roll. The work required to change the motion of the core would come from the friction between the transfer plate and the core, on the opposite side of the core from where web transfer is taking place. This would optimize the transfer condition and further help to reduce any slack in the incoming web due to slip between winding roll and core.

Any change in core speed that will need to be caused by the first winding roll will be limited by the stress that the web nipped between them can tolerate. Any energy added to the core by the winding roll will be accompanied by some slip between them until they match speed. This could result in rips in the first sheet at transfer.

The terms "low friction" and "high friction" as applied to the pinch pad, pinch bar, and upper winding roll are relative terms but are well understood by those skilled in the art. A quantitative value for the friction is not necessary for those skilled in the art, and indeed, quantitative values are difficult to measure because of differences in webs. What is important is that there be a difference in friction between the pinch pad and the pinch bar so that the higher friction surface controls the web. The high friction surface should have a friction which is greater than twice the friction of the low friction surface. The low friction surface can have a coefficient of friction within the range of about 0.01 to 0.5, and the high friction surface can have a coefficient of friction within the range of about 0.5 to 0.8.

Glue Applicator

A. FIGS. 22–28

Figure 22:
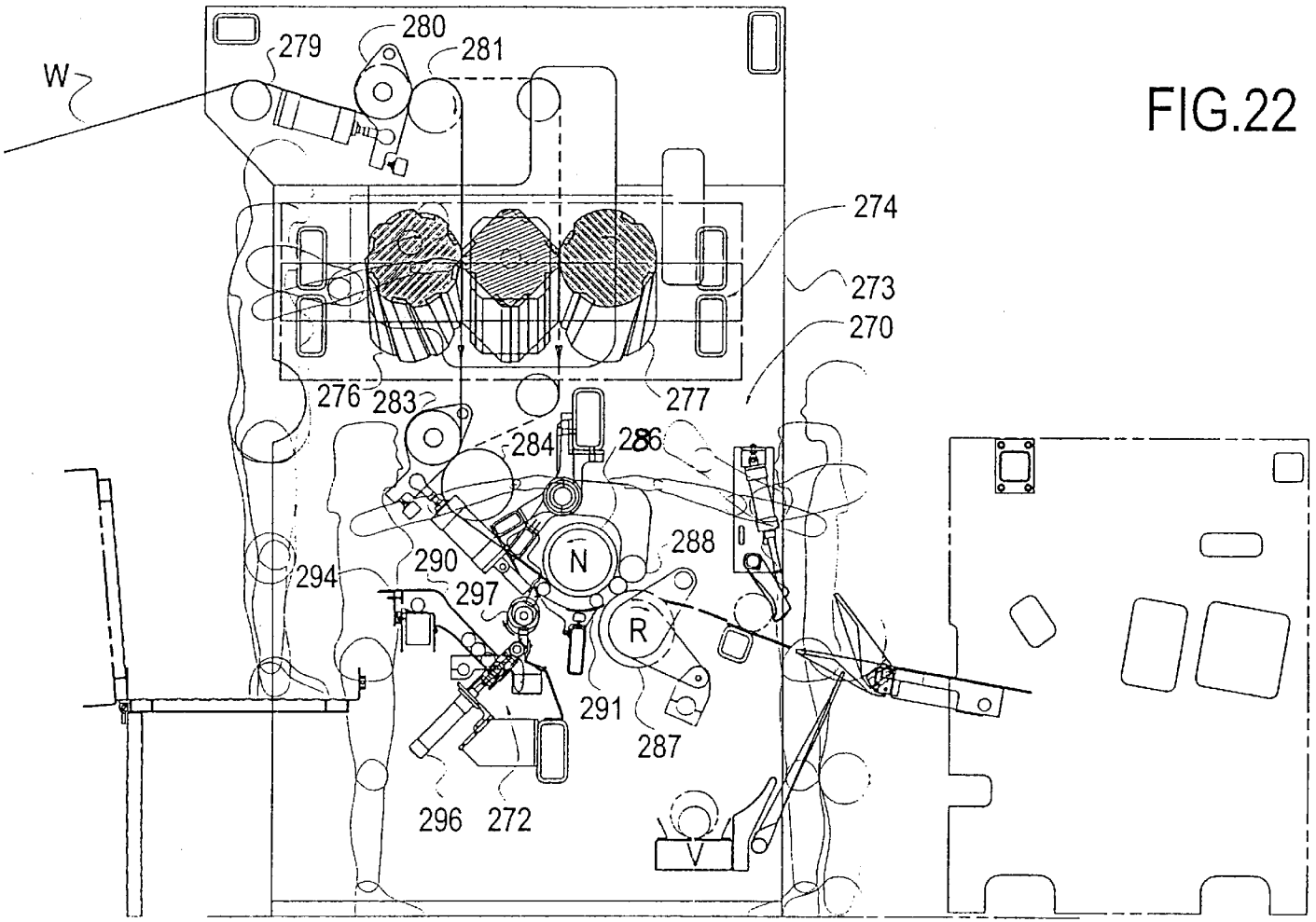
FIG. 22 is a side elevational view of a surface winder which is equipped with a glue applicator in accordance with the invention.

FIG. 22 illustrates a modified embodiment of a rewinder 270 which is equipped with a glue applying apparatus 272.

The rewinder 270 is a surface winder which is similar to the winders which have been previously described. The rewinder includes a frame 273 and a dual perforator assembly 274 which includes a common anvil 275 and a pair of rotating perforating rolls 276 and 277. The perforating roll 276 is used for perforating the web at relatively short intervals, e.g., 41% inches for bathroom tissue. The perforating roll 277 perforates the web at greater intervals for household paper towels.

A web W is advanced over a spreader roll 179, around draw rolls 280 and 281 and between the appropriate perforator roll and the anvil. The perforated web is advanced by draw rolls 283 and 284 to a three roll winding nest formed by upper winding roll 286, lower winding roll 287, and rider roll 288. The web is wound on a core in the winding nest to form a log L.

A stationary pinch plate 290 is mounted on the frame upstream from the upper winding roll 286. A plurality of spaced stationary transfer fingers 291 are mounted on the frame below the upper winding roll and upstream from the lower winding roll 287.

A stack of elongated cylindrical cores C is stored in a chute 294. The bottom core is supported by a support plate 295 (FIG. 23). A reciprocating core pusher 296 pushes the bottom core out of a stack to a rotatable core inserter 297. The core pusher 296 includes a core-engaging end 298 (FIG. 23) which is provided with a concave recess 299 for cradling the core.

Referring to FIGS. 23–27, the core inserter 297 is mounted on a shaft 302 which is rotatably mounted on the frame for rotation about an axis 303. The core inserter includes an arm 304 which extends radially outwardly from the shaft 302 and which is provided with a series of urethane vacuum cups 305. Vacuum ports in the cups communicate with a source of vacuum for holding the core in the cups by suction.

Pinch pads 307 are mounted on the end of pinch arms 308 which are attached to the core inserter. The pinch pads are engaged with the pinch plate 290 as the core inserter rotates.

A pair of L-shaped pivot arms 316 are mounted on a shaft 317 which is rotatably mounted on the frame. The pivot arms are mounted adjacent the sides of the rewinder and straddle the cores. Each pivot arm includes a downwardly extending end portion 318, and a pair of wires 319 and 320 extend between the end portions of the two pivot arms.

Figure 28:
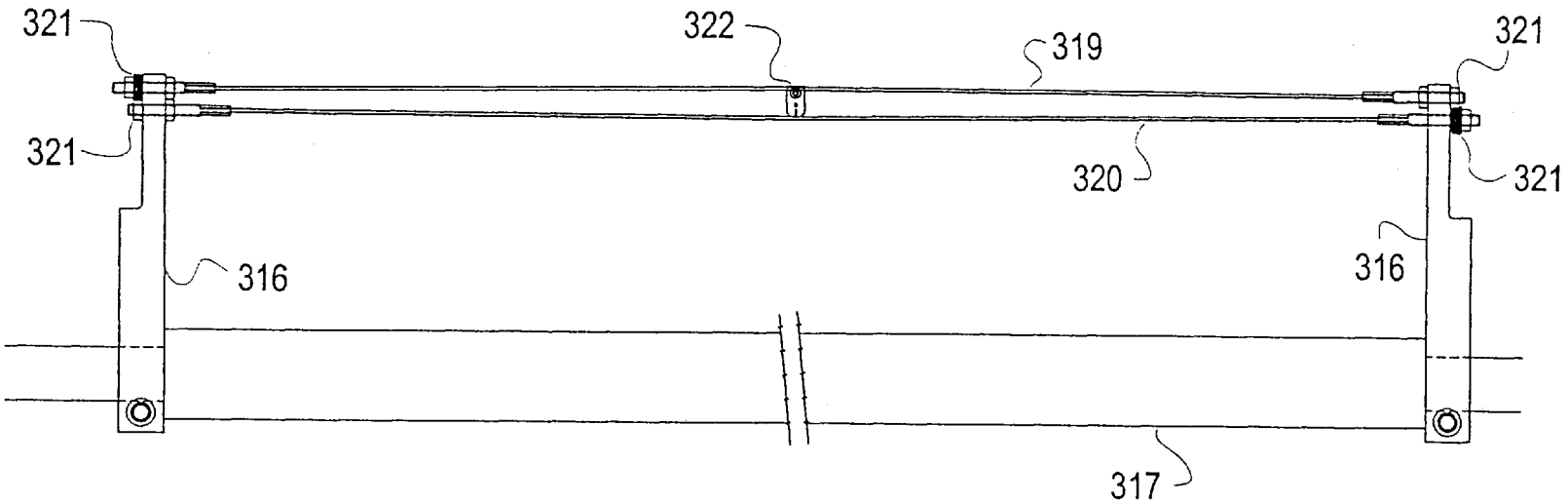
FIG. 28 is a plan view of the glue applicator wires.

Referring to FIG. 28, a single strut 322 extends between the two wires 319 and 320. The wires 319 and 320 are tensioned by nuts 321 which are threaded onto the ends of the wires, and the strut 322 bows or prebends the wire 320 away from the wire 319. A plurality of struts can be used if desired.

B. Operation of FIGS. 22–28

FIG. 23 illustrates a new core $C_1$ supported by the plate 295 and the core pusher 296. The ends of the pivot arms 316 and the wires 319 and 320 are immersed in the glue 312.

In FIG. 24 the core pusher is extended to move the core $C_1$ into the core-holding vacuum cups 305 of the core inserter 297. The core is held in position by both the core pusher and vacuum from the core inserter.

FIG. 25 illustrates the pivot arms 316 raised to move the wire 320 against the core $C_1$. The wires 319 and 320 move through an opening between the plate 295 and the cover 313. The original bowed shape of the wire 320 enables the wire to conform to the compliant core so that the wire contacts the core along the entire length of the core. Glue on the wire is transferred to the core, and the core is provided with a longitudinally extending stripe 323 of glue. The position of the stripe on the core is indicated by a radial line 324 (FIG. 26).

In FIG. 26 the pivot arms 316 have returned to their original position, and the core inserter 297 has rotated clockwise to position the glued core $C_1$ in the space between the pinch plate 290 and the transfer fingers 291. The core is retained by vacuum in the core inserter as the core inserter rotates. The pinch pad 307 pinches the web W against the stationary pinch plate, and the web is about to sever along a perforation downstream from the core $C_1$ to start a new winding cycle. The glue stripe 323 is positioned just upstream of the web and slightly counterclockwise from the point on the core which will first contact the web.

As the web severs, the core inserter continues to rotate moving the core $C_1$ into contact with the web on the upper winding roll 286 and the stationary transfer fingers 291. The core begins to roll on the transfer fingers, and the stripe of glue moves into contact with the web as the core is compressed between the upper winding roll and the transfer fingers. The leading end of the severed web is thereby transferred to the core $C_1$ as illustrated in FIG. 27. As the core continues to roll on the transfer fingers, the web is wound around the core to begin a new log. The core inserters 297 rotate in the spaces between the transfer fingers and return to the position illustrated in FIG. 23 to pick up another core $C_2$.

If desired, the wires 319 and 320 can be replaced by an elongated bar which has greater rigidity than a wire. Also, the width of the glue stripe can be varied by varying the width of the bar.

C. FIGS. 29–32

Another embodiment of a glue applicator is illustrated in FIGS. 29–32. Cores C are stored in a chute 326. Cores are conveyed to the top of the chute by a conveyor 327. A deflector plate at the end of the converter deflects the core from the conveyor to the chute. The bottom core $C_1$ is supported by a plurality of spaced-apart support fingers 229 on the end of a core pusher 330. The core pusher includes a pusher plate 331 which is provided with a concave recess for the core. The pusher plate is reciprocated by piston 332 which is mounted in cylinder 333.

A plurality of spaced-apart rolls 335 and spaced-apart rolls 336 are rotatably mounted in a glue tank 337. The bottom rolls 335 rotate counterclockwise and the top rolls 336 rotate clockwise. The bottom rolls are immersed in glue 338 and transfer glue to the top rolls. Doctor blades 339 remove excess glue from the bottom rolls.

Figure 30:
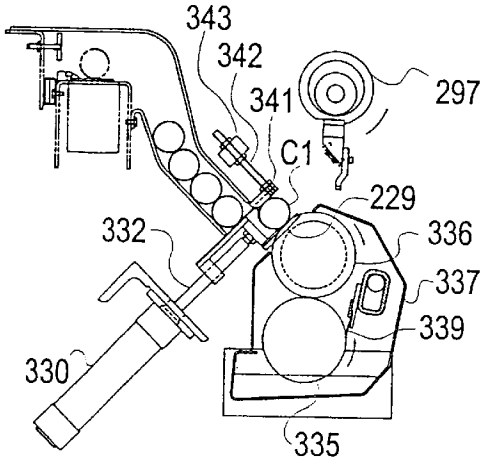
FIG. 30 shows a core being pushed into contact with a rotating glue applying roll.
Figure 32:
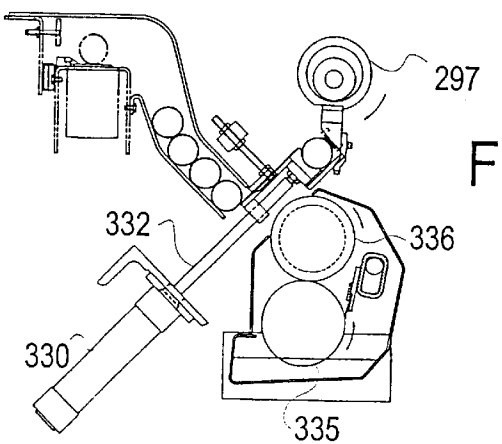
FIG. 32 illustrates the core being pushed into the core inserter.
Figure 29:
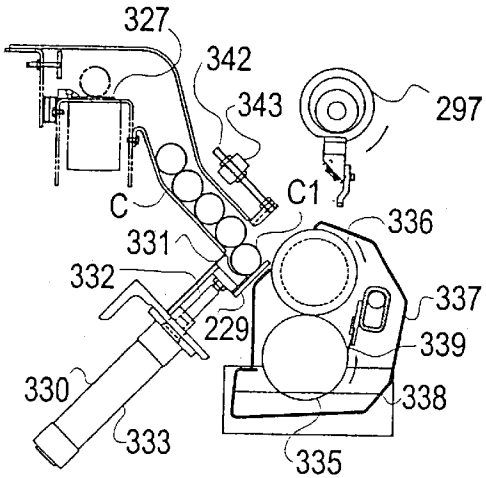
FIG. 29 is a view similar to FIG. 23 of another embodiment of a glue applicator.

A presser plate 341 (FIG. 30) is mounted on a screw 342 which is threadedly engaged with a nut 343 which is rotatably mounted on the frame. The position of the presser plate relative to the top rolls 336 is adjusted to compress the core against the top rolls as the core pusher moves the core past the rolls as illustrated in FIG. 30. The top rolls contact the core between the support fingers 229 and transfers glue to the core. In one specific embodiment the support fingers were spaced 24 inches apart, and the top rolls applied a stripe of glue along the core which was interrupted every 24 inches by the support fingers.

The top rolls 336 are mounted on a common drive shaft which can be rotated by a conventional drive, for example, a servo motor. The speed of the piston 332 of the core pusher can also be controlled by a servo motor. The drives for the core pusher and the top rolls 336 are advantageously controlled by a controller 345 so that the velocity of the piston can be adjusted relative to the surface velocity of the top rolls while the core is in contact with the top rolls.

Figure 31:
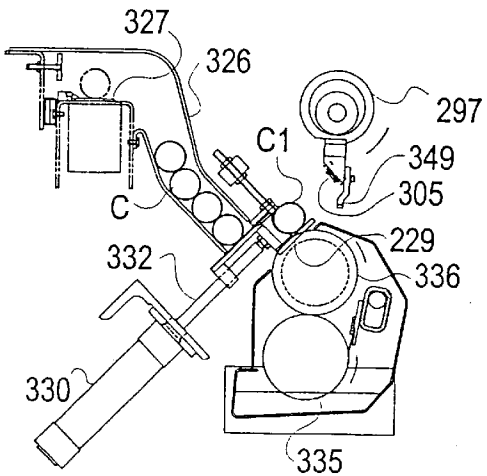
FIG. 31 shows the core pusher accelerating after the glue is applied to the core.

In FIG. 31 the core $C_1$ has moved out of contact with the top rolls 336, and the cylinder 330 is extended to move the core into the core holding vacuum cups of the core inserter 297. The core is retained on the core inserter by vacuum (FIG. 32), and the core inserter rotates the core for insertion between the upper winding roll and the stationary transfer fingers as described with respect to FIGS. 22–28.

D. FIG. 33

Figure 33:
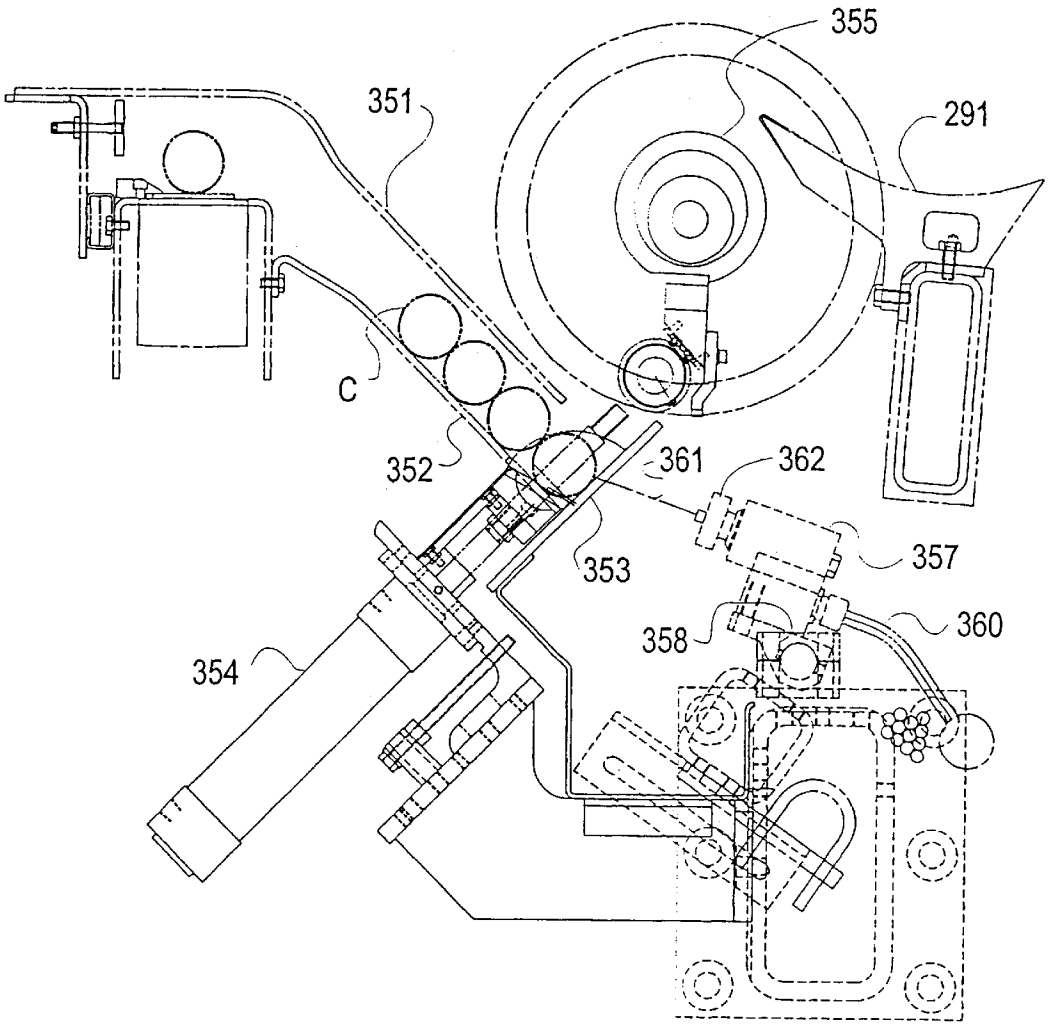
FIG. 33 illustrates-another embodiment of a glue applicator.

FIG. 33 illustrates a third embodiment of glue applicator. Cores C are stored in a chute 351 and are supported by bottom wall 352. The bottom core is also supported by a plurality of spaced-apart support fingers 353. A core pusher 354 moves the bottom core to the core inserter 355.

A sprayer 357 is slidably mounted on a rail 358 which extends parallel to the cores. The sprayer is driven along the rail by motor 359. Glue is supplied to the sprayer by hose 360, and a stream of glue 361 is sprayed from a nozzle 362 on the sprayer.

As the sprayer moves along the rail 358, the stream 361 applies a longitudinally extending stripe of glue on the core. If desired, the stream may be interrupted automatically so that glue does not hit the support fingers 353.

After the stripe is applied the glued core is advanced to the core inserter 355 by the core pusher. The structure and operation of the core pusher 355 is the same as the structure and operation of the core pushers of FIGS. 22–32.

E. Summary of Operation

The glue applicator applies a longitudinal stripe of glue to the core just prior to insertion of the core in the winding machine. The width of the stripe can be adjusted as desired to optimize the amount of glue which is used and the holding strength of the glue. Since the glue is applied just prior to core insertion, the glue does not have time to dry. The glue which is applied to the core is "fresh" glue, and culling of dried cores at start-up is not required. If the stripe of glue on a core does dry before use, a new stripe can be applied without difficulty.

The position of the glue stripe on the core is accurately controlled by the core pusher and the core inserter. The glue stripe can therefore be positioned as desired with respect to the pinch pads and the web so that the glue will contact the severed web at the proper time to transfer the web to the core.

In FIGS. 22–28, the glue is applied to the core after the core is placed on the core inserter, which makes handling of the glued core easier.

Glue applications which apply a longitudinal stripe of glue are simpler than applicators which apply transverse rings of glue. Although linear glue applications have been used in the past, the applicators of FIGS. 22–32 apply the stripe simultaneously to the entire length of the core.

Access to the glue applicators is quick and easy and clean up is facilitated.

The glue applicators described herein have the potential for very high cycle rates, for example, greater than 40 logs per minute.

While in the foregoing specification a detailed description of specific embodiments of the invention was set forth for the purpose of illustration, it will be understood that many of the details herein given can be varied considerably by those skilled in the art without departing from the spirit and scope of the invention.

We claim:

1. A glue applicator for applying a longitudinally extending stripe of glue to an elongated cylindrical core comprising:

a frame, means for supplying elongated cores, means for moving a core from a first position at said core supplying means to a second position, a glue reservoir, an elongated glue applicator movably mounted on the frame for movement between a first position in the glue reservoir to a second position in which the glue applicator extends parallel to and is in contact with a core in the second core position whereby a longitudinally extending stripe of glue may be applied to a core.

2. The apparatus of claim 1 including a core inserter rotatably mounted on the frame and having a core holder for holding a core when the core is in the second core position.

3. The apparatus of claim 1 in which the core holder is provided with a vacuum port for retaining a core in the core holder by vacuum.

4. The apparatus of claim 1 in which the core inserter includes a pinch pad adjacent the core holder whereby the pinch pad can engage a web which is to be wound on a core in the core holder.

5. The apparatus of claim 1 in which the glue applicator comprises an elongated wire.

6. The apparatus of claim 1 in which the glue applicator comprises an elongated bar.

7. A glue applicator for applying a longitudinally extending stripe of glue to an elongated core comprising:

a frame, means for supplying elongated cores, a core inserter rotatably mounted on the frame, means for moving a core from the core supplying means to the core inserter, and a sprayer movably mounted on the frame for movement in the longitudinally dimension of an elongated core for applying a longitudinally extending stripe of glue to a core.

8. The apparatus of claim 7 in which the core inserter is provided with a vacuum port for retaining a core on the core inserter.

9. A glue applicator for applying a longitudinally extending stripe of glue to an elongated cylindrical core comprising:

a frame, means for supplying elongated cores, a glue applicator roll rotatably mounted on the frame, means for moving a core in a direction which extends transversely to the longitudinal dimension of the core from a first position at said core supply means and into contact with said glue applicator roll and to a second position, whereby the glue applicator roll contacts the core along a longitudinal line as the core moves from the first core position to the second core position.

10. The apparatus of claim 9 in which said core moving means moves a core at a velocity which substantially matches the surface velocity of the rotating glue applicator roll.

11. The apparatus of claim 9 including a core inserter rotatably mounted on the frame and having a core holder for holding a core when the core is in the second core position.

12. The apparatus of claim 11 in which the core holder is provided with a vacuum port for retaining a core in the core holder by vacuum.

13. The apparatus of claim 11 in which the core inserter includes a pinch pad adjacent the core holder whereby the pinch pad can engage a web which is to be wound on a core in the core holder.

* * * * *